US009073651B2

(12) United States Patent
Ushidate

(10) Patent No.: US 9,073,651 B2
(45) Date of Patent: Jul. 7, 2015

(54) FILM OPENER AND FILM FITTING SYSTEM

(75) Inventor: Toshiyuki Ushidate, Habikino (JP)

(73) Assignee: FUJI SEAL INTERNATIONAL, INC., Osaka-shi (JP)

( * ) Notice: Subject to any disclaimer, the term of this patent is extended or adjusted under 35 U.S.C. 154(b) by 937 days.

(21) Appl. No.: 13/255,391

(22) PCT Filed: Mar. 26, 2009

(86) PCT No.: PCT/JP2009/001376

§ 371 (c)(1),
(2), (4) Date: Sep. 26, 2011

(87) PCT Pub. No.: WO2010/109535

PCT Pub. Date: Sep. 30, 2010

(65) Prior Publication Data

US 2012/0011810 A1 Jan. 19, 2012

(51) Int. Cl.

| | |
|---|---|
| ***B65B 11/00*** | (2006.01) |
| ***B65B 9/14*** | (2006.01) |
| ***B65C 3/06*** | (2006.01) |

(52) U.S. Cl.
CPC .. *B65B 9/14* (2013.01); *B65C 3/065* (2013.01)

(58) Field of Classification Search
CPC ..... B65C 3/065; B65C 9/14; B65C 9/08; B65C 9/0065; B65B 21/24; B65B 45/00; B65B 53/00; B65B 9/14
USPC ..... 53/585, 590, 591, 397, 398, 441, 386.1, 53/556, 557, 580, 582, 291, 292; 156/443, 156/446, 447, 458, 496, 218, 215, 86, 456
See application file for complete search history.

(56) References Cited

U.S. PATENT DOCUMENTS

| | | | | |
|---|---|---|---|---|
| 4,208,237 | A * | 6/1980 | Heyne | 156/446 |
| 6,016,641 | A * | 1/2000 | Nagano | 53/298 |

FOREIGN PATENT DOCUMENTS

| | | |
|---|---|---|
| JP | 60-220733 | 11/1985 |
| JP | U-02-019708 | 2/1990 |
| JP | 05-132036 | 5/1993 |
| JP | A-06-199322 | 7/1994 |
| JP | A-06-345061 | 12/1994 |
| JP | A-2001-031022 | 2/2001 |
| JP | 2003-237750 | 8/2003 |
| JP | 2006-076629 | 3/2006 |

OTHER PUBLICATIONS

International Search Report issued in International Patent Application No. PCT/JP2009/001376 dated Jul. 7, 2009.
International Preliminary Report on Patentability issued in International Patent Application No. PCT/JP2009/001376 dated Oct. 18, 2011.
Apr. 23, 2013 Office Action issued in Japanese Application No. 2011-505666 (with partial translation).

* cited by examiner

*Primary Examiner* — Stephen F Gerrity
*Assistant Examiner* — Joy N Sanders
(74) *Attorney, Agent, or Firm* — Oliff PLC

(57) ABSTRACT

Provided is a film opener and a film placement system capable of smoothly and securely placing even a thin tubular film around a placement target. The film opener is mounted to a film placement apparatus for opening a tubular film supplied so as to be sheet-like folded and placing the tubular film around a bottle, and includes first and second suction rods and third and fourth suction rods that grip a sheet-like folded label by suction, and the first and second suction rods, and the third and fourth suction rods, separate from each other, and thereby the label is opened, and in a state where the label is open, suction holes of the first suction rod and suction holes of the fourth suction rod oppose each other, and suction holes of the second suction rods and suction holes of the third suction rod oppose each other.

11 Claims, 21 Drawing Sheets

(a)

(b)

(a)

(b)

(a)

(a)

(b)

(b)

FILM OPENER AND FILM FITTING SYSTEM

TECHNICAL FIELD

The present invention relates to a film opener for opening, for example, a tubular film, such as a shrink label and a stretch label, supplied so as to be sheet-like folded, in order to place the tubular film around a placement target, such as a jar and a bottle, and relates to a film placement system to which such a film opener is mounted.

BACKGROUND ART

To a film placement apparatus for placing a tubular film such as a shrink label around the outer periphery of the body of, for example, a jar or a bottle, generally, a tubular film (label) having a predetermined length formed by cutting a sheet-like folded, long strip-like tubular film is sequentially supplied. Thus, to such a film placement apparatus, a film opener is mounted so as to open the tubular film having the predetermined length supplied so as to be sheet-like folded.

Examples of such a film opener include the one shown in FIGS. 21 and 22. As shown in FIGS. 21 and 22, a film opener 90 includes: a pair of openable and closable swinging arms 91, 91; and opening-and-closing driving means 95 that opens and closes the swinging arms 91, 91. The swinging arms 91, 91 include, at their respective ends, gripping sections 92, 92 that grip a film F supplied so as to be sheet-like folded.

The gripping sections 92, 92 include: base sections 93, 93 having a common suction passage formed therein and connected to suction means not shown in the figures; and a plurality of gripping arms 94, 94 connected to the upper and lower portions of the base sections 93, 93 so as to grip the vicinities of the respective ends of various types of films F different in length. The gripping arms 94, 94 have suction holes 94*a*, 94*a* formed on their respective gripping surfaces, the suction holes 94*a*, 94*a* communicated with the common suction passage of the base sections 93, 93 via individual suction passages.

Therefore, the film F supplied so as to be sheet-like folded is received as a result of the gripping sections 92, 92 of the swinging arms 91, 91 gripping the film F as shown in FIG. 22 (*a*). Subsequently, the film F is opened into a tube as shown in FIG. 22 (*b*) by opening the swinging arms 91, 91, with the gripping arms 94, 94 holding the respective sides of the film F by suction by operating the suction means, to separate both sides of the film F from each other.

[PATENT LITERATURE 1] Japanese Laid-Open Patent Publication No. 60-220733

[PATENT LITERATURE 2] Japanese Laid-Open Patent Publication No. 2003-237750

DISCLOSURE OF THE INVENTION

Problems to be Solved by the Invention

Incidentally, examples of a method of placing the film F opened by such a film opener around the body of a bottle container or the like include: a direct method of directly inserting a bottle container or the like into a film by, with a film opener opening the film, causing the bottle container or the like to rise from below the opened film; and an indirect method of, as shown in FIG. 23 (*a*) through (*c*), inserting a shaping member, such as a mandrel 100 having four parasol-like opening and closing rods 101, into the film F opened by the film opener 90, thereby once shaping the shape of the opening of the film F so as to approximate the shape of the body of a bottle container BC or the like by means of such a shaping member, and subsequently pushing down the thus shaped film F from the mandrel 100 by means of a carrier plate 110 or the like, to place the film F around the bottle container BC or the like placed below the mandrel 100.

In the direct method of directly placing a film opened by a film opener around a bottle container or the like, the film is not delivered from the time when the film is opened by the film opener to the time when the film is placed around the bottle container or the like. This has the advantage that a shift is unlikely to occur in the position of the film. As described above, however, it is not possible to open the film F so as to form a shape approximating the shape of the body of a placement target as shown in FIG. 22 (*b*), only by gripping the film F by suction by means of the gripping sections 92, 92 provided at the ends of the pair of openable and closable swinging arms 91, 91, and subsequently opening the pair of openable and closable swinging arms 91, 91. Accordingly, when the bottle container BC or the like is inserted into the opened film F, the shoulder of the bottle container or the like abuts the lower end of the film. Thus, it is not possible to smoothly and securely place the film around the bottle container BC or the like. Such a problem arises in a noticeable manner particularly with the thin film F, because the thin film F is insufficiently stiff and therefore collapses even when in slight contact with the bottle container BC or the like.

In the indirect method described above, on the other hand, the film F opened by the film opener 90 is placed around the bottle container BC or the like so as to be shaped by the mandrel 100 to approximate the shape of the body of the bottle container BC or the like. This makes it unlikely that the lower end of the film F makes contact with the bottle container BC or the like, but requires a shaping mechanism such as the mandrel 100. This increases the film placement apparatus in size, and also increases the number of components. Further, the thin film F, having a thickness of from 20 μm to 40 μm (particularly from 20 μm to 30 μm), is insufficiently stiff. Accordingly, when the shaped film F is pushed down from the mandrel 100 by means of the carrier plate 110 or the like, the film F collapses. Thus, it is not possible to smoothly and securely place the film F around the bottle container BC or the like. Specifically, the indirect method only succeeded in handling a polyethylene terephthalate film (PET film) having a thickness of about 40 μm and an oriented polystyrene film (OPS film) having a thickness of about 50 μm.

Therefore, it is an object of the present invention to provide a film opener and a film placement system capable of smoothly and securely placing even a thin tubular film around a placement target.

Solution to the Problems

To achieve the above object, the invention of claim 1 provides a film opener mounted to a film placement apparatus for opening a tubular film supplied so as to be sheet-like folded and placing the tubular film around a placement target, the film opener including: a first suction rod and a second suction rod that suction one side of the sheet-like folded film at a predetermined distance therebetween in a width direction of the film, the first suction rod and the second suction rod each extending in a longitudinal direction of the film; and a third suction rod and a fourth suction rod that suction the other side of the film at positions corresponding to the first suction rod and the second suction rod, the third suction rod and the fourth suction rod each extending in the longitudinal direction of the film, wherein the first suction rod and the second suction rod that suction the one side of the film, and the third suction rod and the fourth suction rod that suction the other side of the film, separate from each other, and thereby the sheet-like folded film is opened, and in a state where the film is open, suction holes of the first suction rod and suction holes of the fourth suction rod oppose each other, and suction holes of the second suction rod and suction holes of the third suction rod oppose each other.

In the invention of claim 2, on the basis of the film opener according to the invention of claim 1, a distance between a suction position of the first suction rod and a suction position of the second suction rod and a distance between a suction position of the third suction rod and a suction position of the fourth suction rod are changeable.

In the invention of claim 3, on the basis of the film opener according to the invention of claim 2, the first suction rod, the second suction rod, the third suction rod, and the fourth suction rod are each formed in a prism having a plurality of side surfaces that serve as gripping surfaces for the film, and the gripping surfaces for the film are switchable by rotating the suction rod around an axial center of the suction rod, the suction holes are formed on the plurality of side surfaces that serve as the gripping surfaces for the film, at positions different in width directions of the side surfaces, and switching of the gripping surfaces for the film allows a change in positions of the suction holes relative to the film.

The invention of claim 4 provides a film placement system including: a placement target supplying apparatus for supplying a placement target to a film placement position; a film supplying apparatus for supplying a sheet-like folded tubular film to a film supply position; and a film placement apparatus for receiving the film supplied by the film supplying apparatus at the film supply position, and placing the film around the placement target supplied by the placement target supplying apparatus to the film placement position, wherein the film opener according to claim 1, 2, or 3 is mounted to the film placement apparatus.

The invention of claim 5 provides a film placement system including: a placement target supplying apparatus for supplying a placement target to a placement target supply position; a film supplying apparatus for supplying a sheet-like folded tubular film to a film supply position; a rotary film placement apparatus for receiving the placement target supplied by the placement target supplying apparatus at the placement target supply position and conveying the placement target to a placement target sending position, and also for receiving the film supplied by the film supplying apparatus at the film supply position and placing the film around the placement target while conveying the placement target from the placement target supply position to the placement target sending position; and a placement target discharge apparatus for discharging the placement target around which the film has been placed by the film placement apparatus, wherein the film placement apparatus includes numerous film placement heads attached at regular intervals in a concentric circle around a rotating shaft, and the film opener according to claim 1, 2, or 3 is mounted to each of the film placement heads.

In the invention of claim 6, on the basis of the film placement system according to the invention of claim 5, a film delivery unit is mounted to each of the film placement heads, the film delivery unit receiving the film supplied by the film supplying apparatus at the film supply position and delivering the film to the film opener.

Advantageous Effects of the Invention

As described above, in the film opener according to the invention of claim 1, a first suction rod and a second suction rod are provided that suction one side of the sheet-like folded film at a predetermined distance therebetween in a width direction of the film, the first suction rod and the second suction rod each extending in a longitudinal direction of the film; and a third suction rod and a fourth suction rod are provided that suction the other side of the film at positions corresponding to the first suction rod and the second suction rod, the third suction rod and the fourth suction rod each extending in the longitudinal direction of the film, wherein in a state where the sheet-like folded film is open as a result of the first suction rod and the second suction rod that suction the one side of the film, and the third suction rod and the fourth suction rod that suction the other side of the film, separating from each other, suction holes of the first suction rod and suction holes of the fourth suction rod oppose each other, and suction holes of the second suction rod and suction holes of the third suction rod oppose each other. This makes it possible to cleanly open the film so as to form a shape approximating the shape of the body of a rectangular tubular, or round tubular, placement target. Therefore, even in the case of employing a direct method of directly placing a film opened by a film opener around a placement target such as a bottle container, when the placement target is inserted into the opened film, or when the opened film is placed around the placement target, the placement target hardly makes contact with the film. This makes it possible to smoothly and securely place even a tight and thin film around a placement target.

In the film opener according to the invention of claim 2, a distance between a suction position of the first suction rod and a suction position of the second suction rod and a distance between a suction position of the third suction rod and a suction position of the fourth suction rod are changeable. Thus, even when the width of the film has been changed within a certain range, it is not necessary to replace the film opener per se. This facilitates switching the models of the film opener.

Particularly, in the film opener according to the invention of claim 3, the first suction rod, the second suction rod, the third suction rod, and the fourth suction rod are each formed in a prism having a plurality of side surfaces that serve as gripping surfaces for the film, and the gripping surfaces for the film are switchable by rotating the suction rod around an axial center of the suction rod, and the suction holes are formed on the plurality of side surfaces that serve as the gripping surfaces for the film, at positions different in width directions of the side surfaces. Thus, only the rotations of the first suction rod, the second suction rod, the third suction rod, and the fourth suction rod make it possible to change the distance between the suction position of the first suction rod and the suction position of the second suction rod and the distance between the suction position of the third suction rod and the suction position of the fourth suction rod. This provides an excellent workability of switching the models of the film opener.

In the film placement system according to the invention of claim 4 and the film placement system according to the invention of claim 5, the film opener according to claim 1, 2, or 3 is mounted to a film placement apparatus for opening a film and placing the film around a placement target, and is also mounted to each of film placement heads of a rotary film placement apparatus. Thus, even when a thin film is handled, each film placement apparatus can employ a direct method of directly placing a film opened by a film opener around a placement target. This makes it possible to smoothly and securely place a tight and thin film around a placement target, and also makes it possible to make the whole film placement apparatus compact.

Particularly, in the film placement system according to the invention of claim 6, a film delivery unit is mounted to each of the film placement heads, the film delivery unit receiving the film supplied by the film supplying apparatus at the film supply position and delivering the film to the film opener. This makes it possible to deliver the film from the film delivery unit to the film opener in a stable state, and makes it unlikely that a shift occurs in the position of the film when the film is delivered from the film delivery unit to the film opener.

BRIEF DESCRIPTION OF THE DRAWINGS

FIG. 10 (*b*) is a side view of the label delivery unit.

FIG. 11 (*b*) is a side view of the label opener.

FIG. 13 (*b*) is a cross-sectional view along line W-W in FIG. 12 (*a*); FIG. 13 (*c*) is a side view of a base pipe included in the suction rod; and FIG. 13 (*d*) and (*e*) is side views of an outer pipe included in the suction rod.

FIG. 14 (*b*) is a plan view of the state where the label opener has opened the sheet-like folded label.

FIG. 15 (*b*) is a plan view of the state where the label opener has opened the sheet-like folded label.

FIG. 17 (*b*) and (*d*) is a plan view of the label placement operation of the label placement head.

FIG. 18 (*b*) and (*d*) is a plan view of the label placement operation of the label placement head.

FIG. 19 (*b*) and (*d*) is a plan view of the label placement operation of the label placement head.

FIG. 20 (*b*) and (*d*) is a plan view of the label placement operation of the label placement head.

FIG. 22 (*b*) is a plan view of the state where the film opener has opened the film.

DESCRIPTION OF THE REFERENCE CHARACTERS

Figure 1:
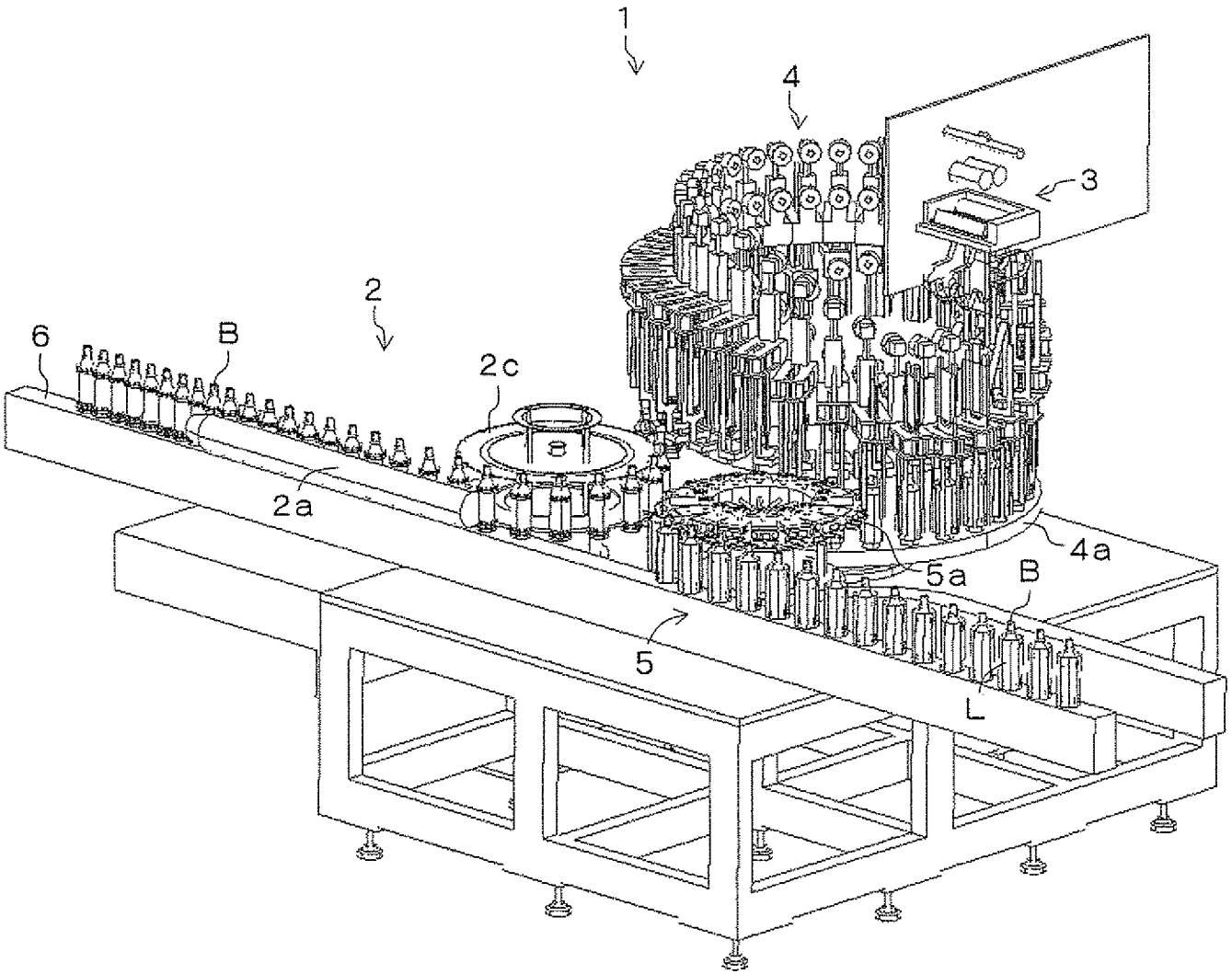
FIG. 1 is a schematic perspective view of a label placement system corresponding to an embodiment of a film placement system according to the present invention.

1 label placement system (film placement system)
2 bottle supplying apparatus (placement target supplying apparatus)
3 label supplying apparatus (film supplying apparatus)
4 label placement apparatus (film placement apparatus)
4*a* support disk
4*b* cylindrical body
5 bottle discharge apparatus (placement target discharge apparatus)
6 belt conveyor
7 rotating shaft
11 label base material sending unit
12 label base material cutting unit
13 upstream belt conveying unit
16 downstream belt conveying unit
18 label detection sensor
20 label placement head (film placement head)
21 support frame
22 slide rail
30 bottle holding unit
31 bottle mounting stand
40 label delivery unit (film delivery unit)
41 base plate
42, 47 support member
43 take-up member
44 suction rod
44*a* suction hole
45 slide guide
46 cam mechanism
48 suction pipe
50 label opener (film opener)
51 base member
52 main unit
53 upper base
54 lower base
55 coupling plate
56 coupling rod
57 suction block
58, 59 opening and closing arm
60A first suction rod
60B second suction rod
60C third suction rod
60D fourth suction rod
61 base pipe
61*a* suction passage
62 smaller-diameter portion
62*a* slit
62*b* convex section
63 larger-diameter portion
64 outer pipe
64*a* larger-diameter section of fitting hole
64*b* suction hole
64*c* concave section
65 washer
66 coil spring
67 opening and closing mechanism

68 slide guide
69 slide rail
70 rack
71 sector gear
72 rotating shaft
73, 74 spur gear
75 advancement-and-retreat driving mechanism
76 cam follower
77 cam member
78 base member
79 slide guide
80 coil spring
81 cam mechanism
81 a cam follower
81*b* cam groove
82 slide guide
83 cam mechanism
83*a* cam follower
83*b* cam groove
84 suction pipe
B PET bottle (placement target)
L shrink label (film)

BEST MODE FOR CARRYING OUT THE INVENTION

Figure 2:
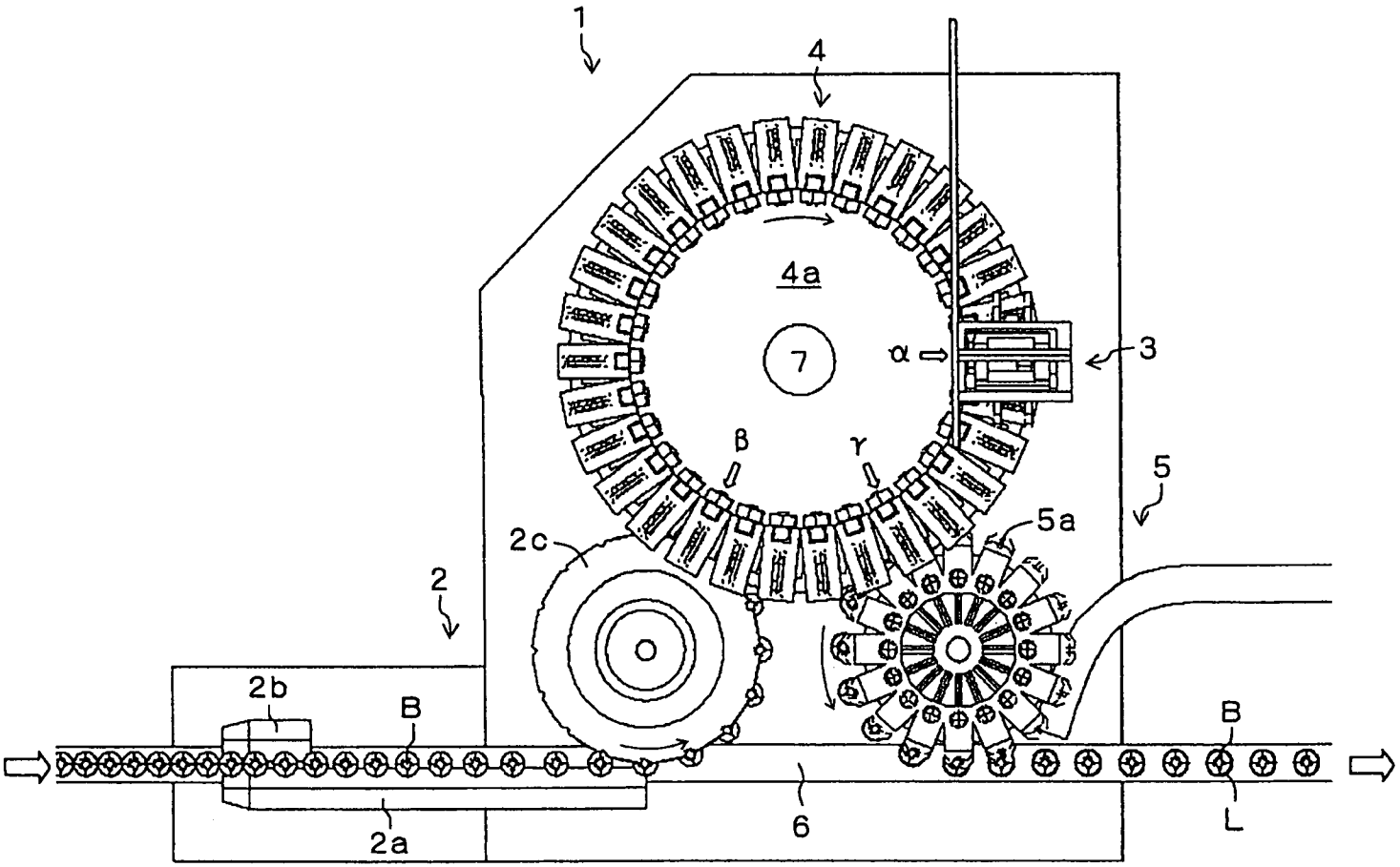
FIG. 2 is a plan view of the label placement system.
Figure 3:
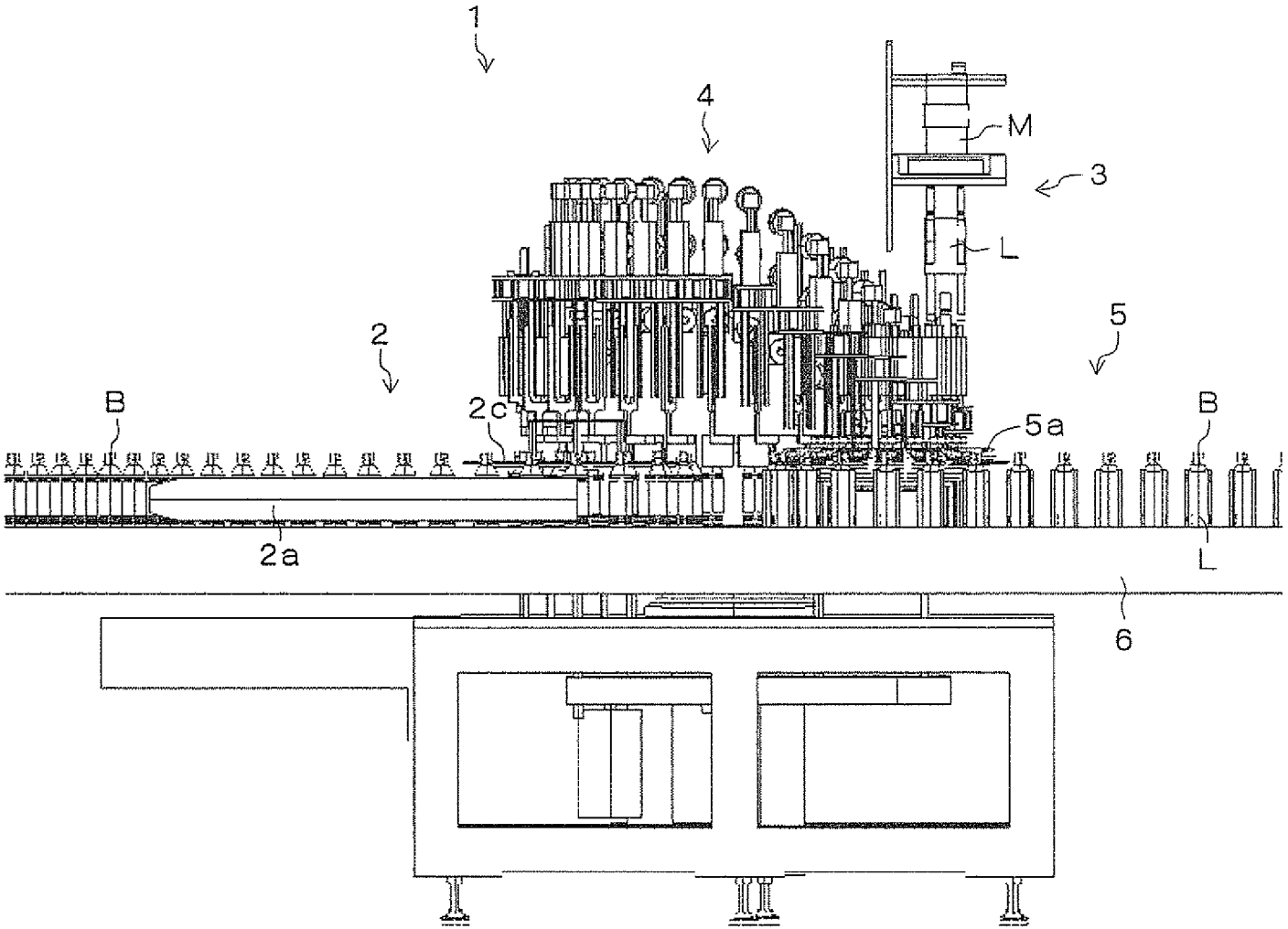
FIG. 3 is a front view of the label placement system.

With reference to the drawings, an embodiment is described. FIGS. 1 through 3 show a label placement system 1 for placing a tubular shrink label (hereinafter referred to as "label") L around a PET bottle (hereinafter referred to as "bottle") B, the label formed of a heat-shrinkable film having a thickness of from 20 μm to 60 μm of, for example, a polyester resin or a polystyrene resin. The label placement system 1 includes: a bottle supplying apparatus 2 having a belt conveyor 6, screws 2*a* and 2*b*, and a star wheel 2*c*; a label supplying apparatus 3 that forms the label L by sequentially cutting a long label-forming base material M fed from a base material roll by a base material feed section (not shown), and sequentially supplies the label L to a label supply position α; a rotary label placement apparatus 4 that receives the bottle B supplied by the bottle supplying apparatus 2 at a bottle supply position β and conveys the bottle B to a bottle sending position γ, and that also receives the label L from the label supplying apparatus 3 at the label supply position α and places the label L around the bottle B while conveying the bottle B from the bottle supply position β to the bottle sending position γ; and a bottle discharge apparatus 5 that discharges the bottle B around which the label L has been placed by the label placement apparatus 4. The bottle discharge apparatus 5 includes: a bottle sending unit having a belt conveyor 6; and a bottle delivery unit 5*a* that delivers the bottle B placed in the label L, between the label placement apparatus 4 and the bottle sending unit.

Figure 4:
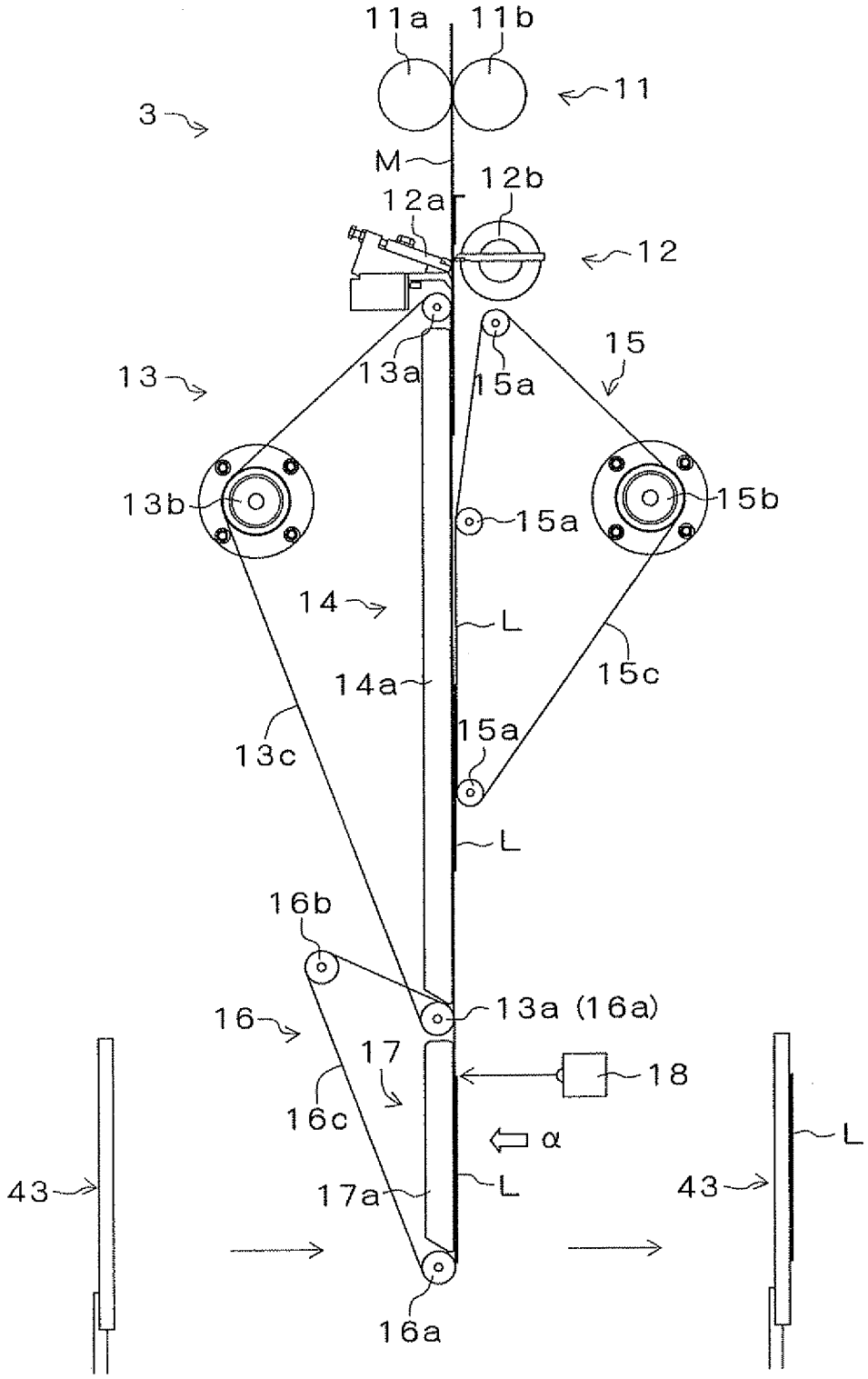
FIG. 4 is a front view of a label supplying apparatus included in the label placement system.
Figure 5:
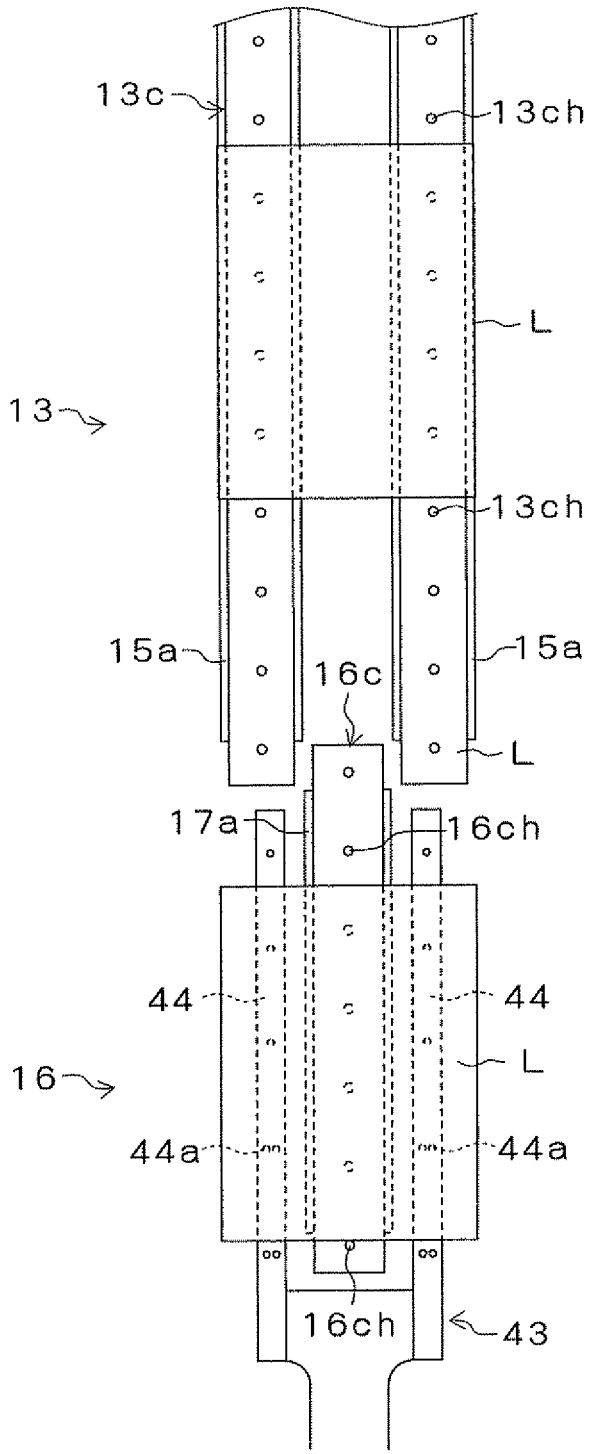
FIG. 5 is a side view of the label supplying apparatus.

As shown in FIGS. 4 and 5, the label supplying apparatus 3 includes: a label base material sending unit 11 that continuously sends the long label-forming base material M fed from the base material roll by the base material feed section (not shown), the label base material sending unit 11 including a driving roller 11*a* that is driven by an independent servomotor, and a driven roller 11*b* that sandwiches the sheet-like folded label-forming base material M between the driven roller 11*b* and the driving roller 11*a*; a label base material cutting unit 12 that sequentially cuts, at predetermined cutting intervals, the label-forming base material M sent by the label base material sending unit 11, the label base material cutting unit 12 including a fixed blade 12*a* provided in a fixed manner at a base material cutting position, and a rotary blade 12*b* that is driven to rotate by an independent servomotor; and an upstream belt conveying unit 13 and a downstream belt conveying unit 16 that sequentially convey the label L formed as a result of the label base material cutting unit 12 cutting the long label-forming base material M, to the label supply position α.

As shown in FIGS. 4 and 5, the upstream belt conveying unit 13 includes: two feed belts 13*c*, 13*c* that are passed over a driving pulley 13*b* and guide rollers 13*a* provided in the vicinity of the base material cutting position and at a position in the vicinity of the label supply position α, respectively, and move cyclically between the vicinity of the base material cutting position and the position in the vicinity of the label supply position α at a speed faster than the speed of supplying the label-forming base material M; a suction mechanism 14 that causes the two feed belts 13*c*, 13*c* to hold the label L by suction; and suction assistance means 15 that assists the suction mechanism 14 in the operation of the feed belts 13*c*, 13*c* holding the label L by suction, by bringing the label L into firm contact with the feed belts 13*c*, 13*c* sequentially from the lower end to the upper end of the label L. The driving pulley 13*b* is driven to rotate by an independent servomotor.

As shown in FIG. 5, the feed belts 13*c*, 13*c* are placed parallel to each other at a distance narrower than the width of the label L to be conveyed, and have numerous suction holes 13*ch* formed at central portions in the width directions of the feed belts 13*c*, 13*c* at regular intervals along the longitudinal directions thereof.

As shown in FIG. 4, the suction mechanism 14 includes: a pair of suction chambers 14*a*, 14*a* placed along the respective feed belts 13*c*, 13*c* between the guide rollers 13*a*; and suction apparatuses not shown in the figures, such as vacuum pumps connected to the suction chambers 14*a*, 14*a* through tubes or the like, respectively, not shown in the figures. Suction openings are open on the surfaces of the suction chambers 14*a*, 14*a* that are in contact with the feed belts 13*c*, respectively.

As shown in FIG. 4, the suction assistance means 15 is provided so as to oppose the feed belts 13*c*, 13*c* across the conveying line for the label L, and includes three guide rollers 15*a*, a driving pulley 15*b*, and a belt 15*c* passed over them. The driving pulley 15*b* is driven by the servomotor described above that moves the feed belts 13*c* cyclically. The rotational speed of the driving pulley 15*b* is set such that the belt 15*c* moves cyclically at the same speed as the moving speed of the feed belts 13*c*.

The downstream belt conveying unit 16 includes: a feed belt 16*c* that is passed over a driving pulley 16*b* and two guide rollers 16*a* provided one above the other across the label supply position α, and moves cyclically between above and below the label supply position α; and a suction mechanism 17 that causes the feed belt 16*c* to hold the label L by suction. The driving pulley 16*b* is driven to rotate by an independent servomotor.

The feed belt 16*c* is narrower than the label L to be conveyed, and has numerous suction holes 16*ch* formed at a central portion in the width direction of the feed belt 16*c* at regular intervals along the longitudinal direction thereof, so as to hold the label L by suction at a central portion in the width direction of the label L.

As shown in FIG. 4, the suction mechanism 17 includes: a suction chamber 17*a* placed along the feed belt 16*c* between the guide rollers 16*a*; and a suction apparatus not shown in the figures, such as a vacuum pump connected to the suction chamber 17*a* through a tube or the like not shown in the figures. A suction opening is open on the surface of the suction chamber 17*a* that is in contact with the feed belt 16*c*.

The label supplying apparatus 3 includes a control unit not shown in the figures that controls the operations of the label base material sending unit 11, the label base material cutting unit 12, the upstream belt conveying unit 13, and the downstream belt conveying unit 16 in synchronization with the operation of the label placement apparatus 4 on the basis of: a label detection signal output from a label detection sensor 18 that detects the upper end of the label L delivered by the upstream belt conveying unit 13, at an upper portion of the downstream belt conveying unit 16; and a pulse signal output from an encoder attached to a rotating spindle of the rotary label placement apparatus 4. When a shift has occurred in the timing of the label detection sensor 18 detecting the label L, the control unit adjusts the moving speed of the feed belt 16*c* of the downstream belt conveying unit 16 on the basis of the amount of shift, so that the label L is conveyed while a shift in the timing of supplying the label L caused by a shift in the label L is modified, and ultimately, the label L is always stopped at the label supply position α at appropriate timing of supplying the label L.

As shown in FIGS. 1, 2, 6, and 7, the label placement apparatus 4 includes numerous label placement heads 20 provided so as to stand at regular intervals in a concentric circle around a rotating shaft 7 on a support disk 4*a* attached to the rotating shaft. Each label placement head 20 opens the sheet-like folded tubular label L received at the label supply position α, and places the opened label L around the body of the bottle B while the bottle B received at the bottle supply position β is conveyed to the bottle sending position γ.

The label placement head 20 includes: a bottle holding unit 30 having a bottle mounting stand 31 which is fixed on the support disk 4*a* and on which the bottle B received at the bottle supply position β is mounted, and also having suction means not shown in the figures that holds the bottle B on the bottle mounting stand 31 by suctioning the bottom portion of the bottle B mounted on the bottle mounting stand 31; and a label opener 50 that receives via a label delivery unit 40 the label supplied to the label supply position α, opens the label into a tube, and subsequently places the opened label L around the body of the bottle B. The label delivery unit 40 and the label opener 50 rise and fall along a slide rail 22 fixed to a plate-like support frame 21 provided so as to stand on the support disk 4*a*.

As shown in FIGS. 6, 7, 8, and 10, the label delivery unit 40 includes: a generally Y-shaped take-up member 43 fixed to a base plate 41 via a support member 42; a slide guide 45 that is attached to the base plate 41 and rises and falls along the slide rail 22 fixed to the support frame 21; and a cam mechanism 46 that causes the take-up member 43 to rise and fall.

Figure 10:
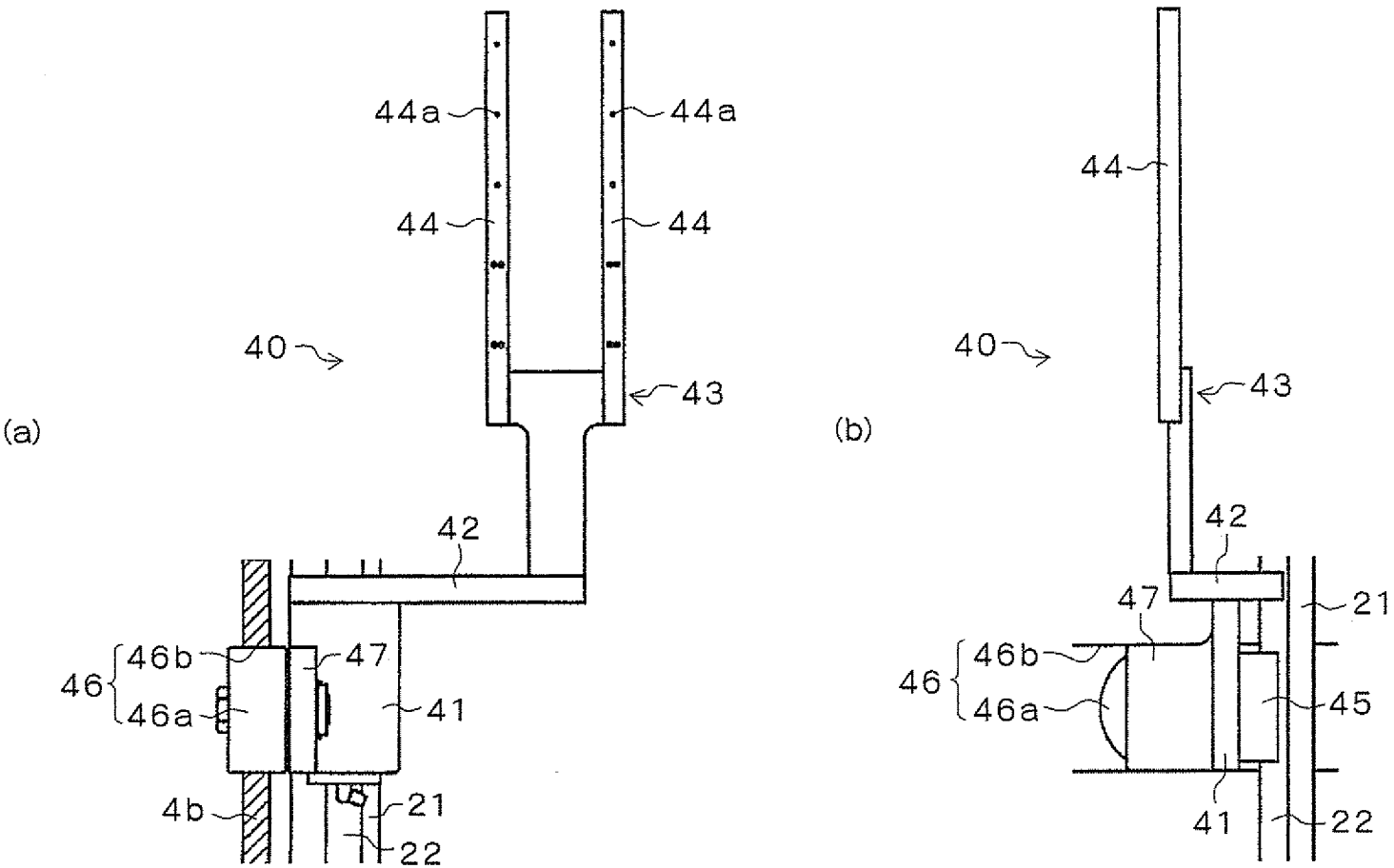
FIG. 10 (*a*) is a front view of a label delivery unit mounted to the label placement head.

As shown in FIG. 10 (*a*), the take-up member 43 includes a pair of suction rods 44, 44 that hold one side of the label L by suction. As shown in FIG. 5, the distance between the suction rods 44, 44 is set such that the suction rods 44, 44 can pass outside the feed belt 16*c* of the downstream belt conveying unit 16 of the label supplying apparatus 3 at the label supply position α.

On the label holding surfaces of the suction rods 44, a plurality of suction holes 44*a* are formed in the vertical direction at central portions in the width directions of the suction rods 44, and suctioning is performed by suction apparatuses not shown in the figures, such as vacuum pumps connected to the suction rods 44, respectively, through an expandable and contractible suction pipe 48 that extends upward from the support disk 4*a*.

The cam mechanism 46 includes: a cam follower 46*a* attached to the base plate 41 via a support member 47; and a cam groove 46*b* formed on a cylindrical body 4*b* provided inside the label placement head 20 in a fixed manner, the cam follower 46*a* fitting the cam groove 46*b*. The rise and fall of the cam follower 46*a* along the cam groove 46*b* cause the slide guide 45 attached to the base plate 41 to rise and fall along the slide rail 22. Accordingly, the take-up member 43 attached to the base plate 41 rises and falls.

Therefore, as shown in FIGS. 3 through 5, when the suction rods 44, 44 of the take-up member 43, rotating together with the label placement head 20, pass through the label supply position α, the suction rods 44, 44 receive the label L so as to hook it, the label L supplied so as to be held by suction by the feed belt 16*c* of the label supplying apparatus 3, and hold the label L by suction on the label holding surfaces of the suction rods 44, 44.

As shown in FIGS. 6 through 9 and FIGS. 11 through 15, the label opener 50 includes: a main unit 52 fixed to a base member 51; a slide guide 82 that is attached to the base member 51 and rises and falls along the slide rail 22 fixed to the support frame 21; and a cam mechanism 83 that causes the main unit 52 to rise and fall.

Figure 6:
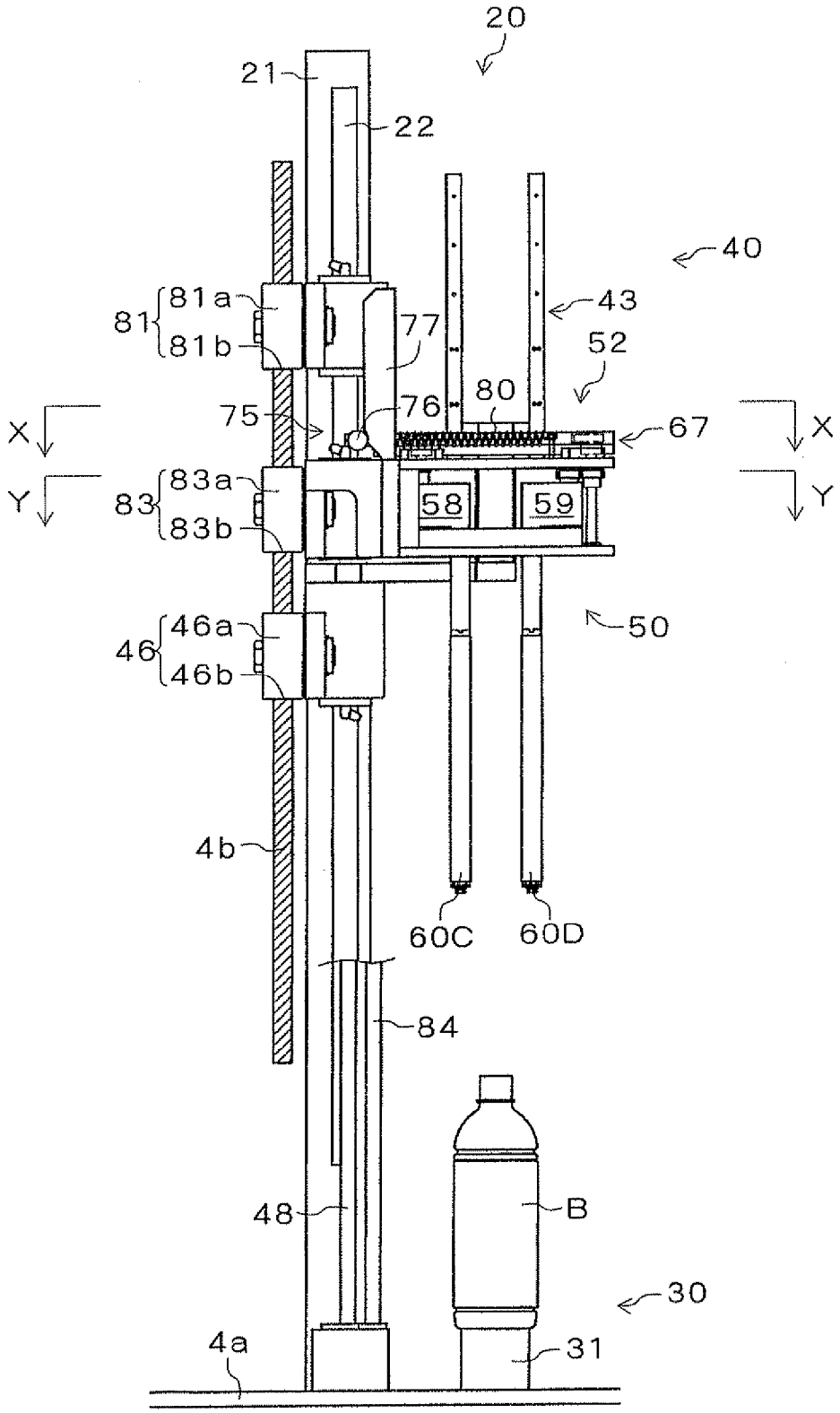
FIG. 6 is a side view of a label placement head mounted to a label placement apparatus included in the label placement system.
Figure 7:
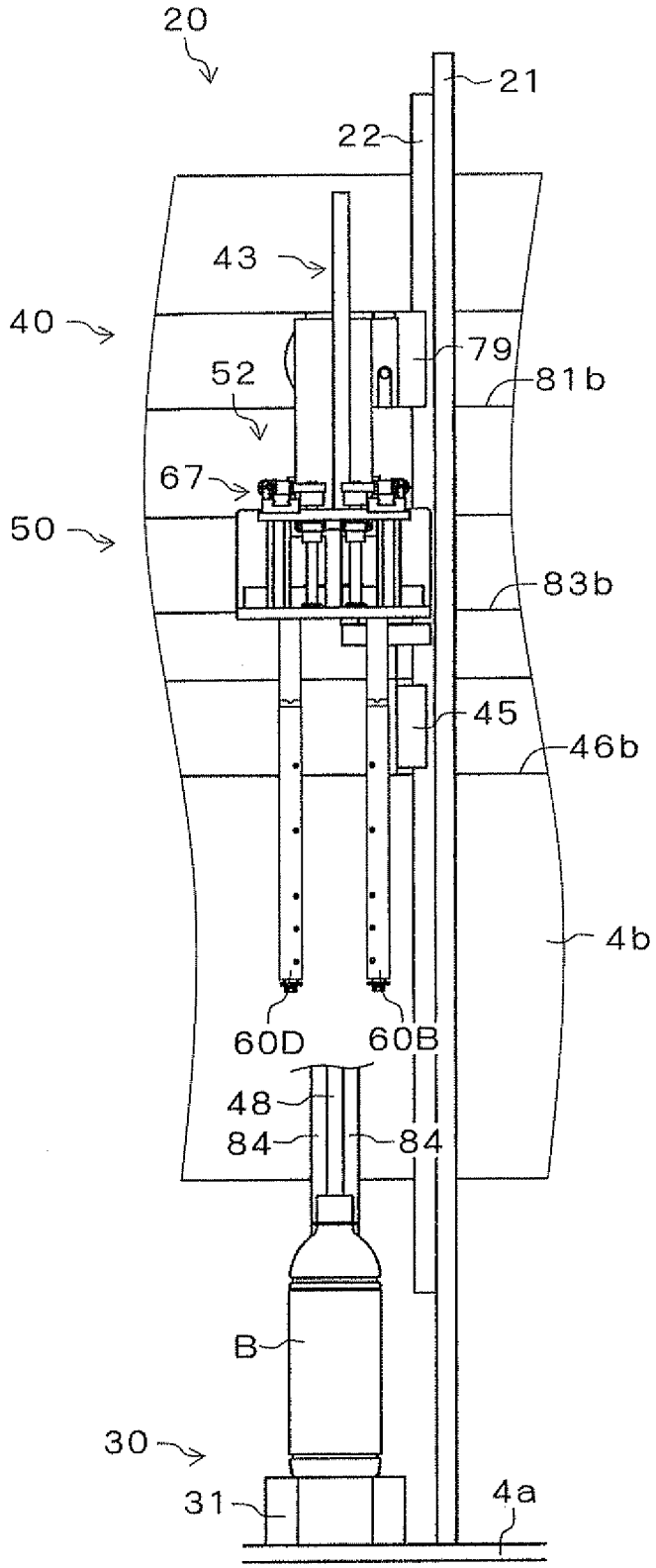
FIG. 7 is a front view of the label placement head.
Figure 14:
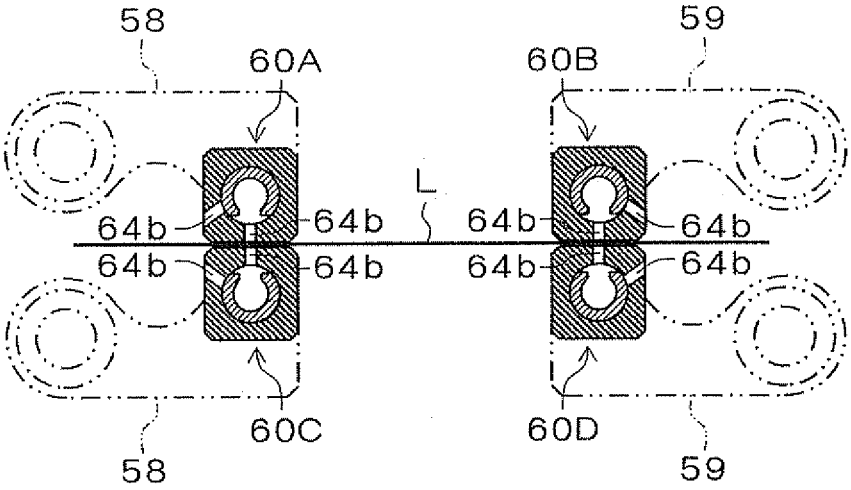
FIG. 14 (*a*) is a plan view of the state where the label opener grips a sheet-like folded label.
Figure 14:
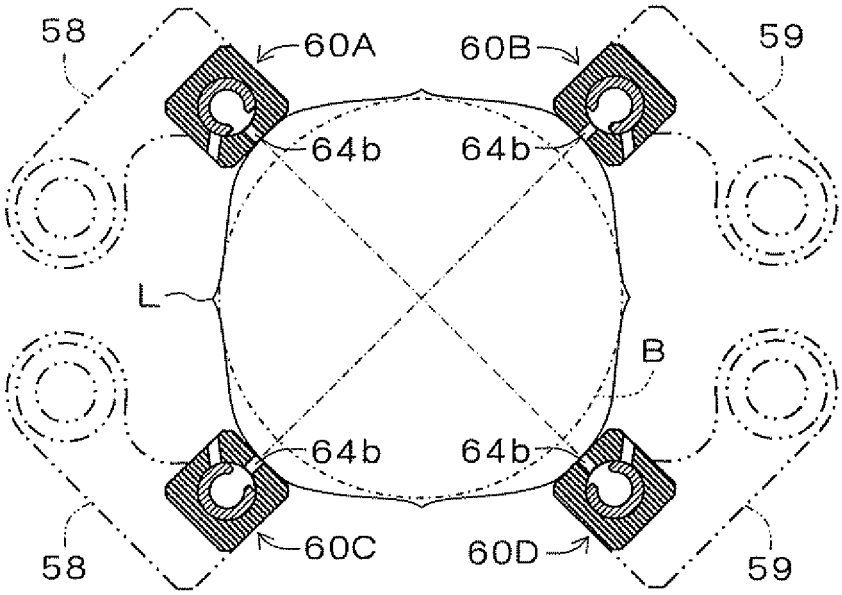

The main unit 52 includes: a ring-shaped upper base 53 and a ring-shaped lower base 54 whose respective central portions are open; coupling plates 55 and coupling rods 56 that couple the upper base 53 and the lower base 54 at a predetermined distance therebetween in the vertical direction; suction blocks 57, 57 provided on the lower base 54 so as to surround the opening thereof and connected to expandable and contractible suction pipes 84, 84 that extend upward from the support disk 4*a*, each suction block having a suction passage formed therewithin; two pairs, opening and closing arms 58, 58 and opening and closing arms 59, 59, supported by the upper base 53 and the suction blocks 57, 57 in an openable and closable manner such that the opening and closing arms 58, 58 oppose each other and the opening and closing arms 59, 59 oppose each other, each arm having a suction passage formed therewithin and having a hook shape such that its end is curved inward; first through fourth suction rods 60 (60A, 60B, 60C, 60D) attached to the lower surfaces of the ends of the opening and closing arms 58, 58 and 59, 59, respectively, and extending downward; and an opening and closing mechanism 67 that simultaneously opens and closes the two pairs, opening and closing arms 58, 58 and opening and closing arms 59, 59. As shown in FIG. 14 (*a*), one end in the width direction of the sheet-like folded label L (the position inside from one of the edges of the label L by approximately one-fourth of the full width of the label L) is gripped by the first suction rod 60A and the third suction rod 60C attached to one of the pairs, namely the opening and closing arms 58, 58; and the other end in the width direction of the sheet-like folded label L (the position inside from the other edge of the label L by approximately one-fourth of the full width of the label L) is gripped by the second suction rod 60B and the fourth suction rod 60D attached to the other pair, namely the opening and closing arms 59, 59. It should be noted that the label delivery unit 40 described above is placed below the label opener 50; however, when the take-up member 43 has risen, the label delivery unit 40 extends upward, as shown in FIGS. 6 and 7, so as to pass through the openings of the upper base 53 and the lower base 54 of the main unit 52 from below.

Figure 12:
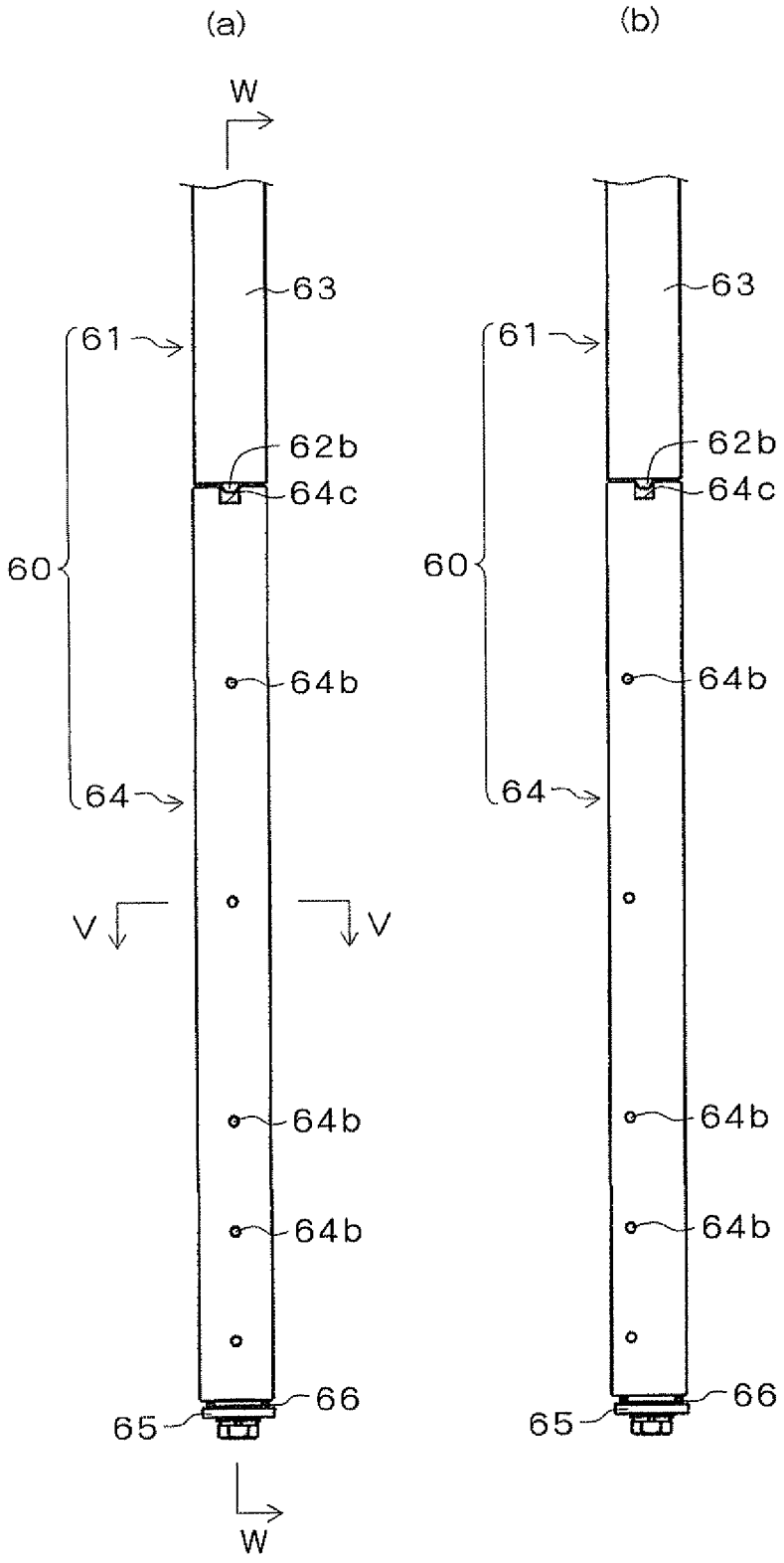
FIG. 12 (*a*) and (*b*) is side views of a suction rod included in the label opener.
Figure 13:
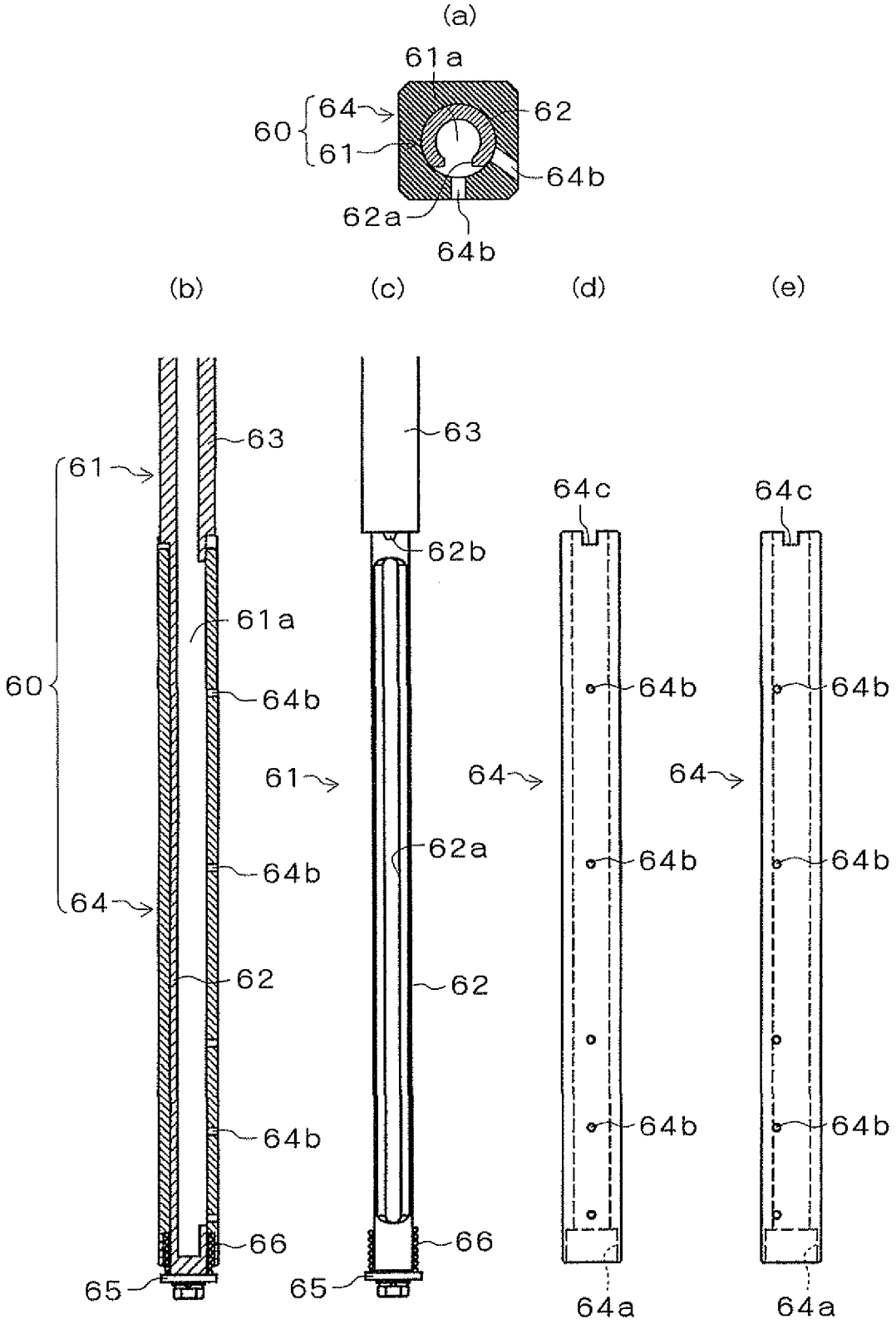
FIG. 13 (*a*) is a cross-sectional view along line V-V in FIG. 12 (*a*)

As shown in FIG. 12 (*a*) and (*b*) and FIG. 13 (*a*) through (*e*), the suction rods 60 (60A, 60B, 60C, 60D) each include: a base pipe 61 connected to the lower surface of the end of the corresponding one of the opening and closing arms 58, 58 and 59, 59, the base pipe 61 having a suction passage 61*a* formed at its center; an outer pipe 64 that is square-shaped in cross section, has a round fitting hole, and is caused to externally fit a smaller-diameter portion 62 of the base pipe 61 so as to be rotatable; a washer 65 that is bolted to the lower end of the base pipe 61 and is larger in diameter than the lower end of the base pipe 61; and a coil spring 66 that is accommodated under a certain amount of compression in a larger-diameter section 64*a* of the fitting hole formed at the lower end of the outer pipe 64, as a result of the lower end of the base pipe 61 being fit into the coil spring 66 and the lower end of the coil spring 66 abutting the washer 65. The bias force of the coil spring 66 biases the outer pipe 64 upward, and causes the upper end of the outer pipe 64 to abut a stepped section formed between the smaller-diameter portion 62 and a larger-diameter portion 63 of the base pipe 61. It should be noted that in the state where the suction rods 60 (60A, 60B, 60C, 60D) are connected to the opening and closing arms 58, 58 and 59, 59, respectively, the suction passages 61*a* of the base pipes 61, the suction passages of the opening and closing arms 58, 58 and 59, 59, and the suction passages of the suction blocks 57, 57 are connected to each other.

The outer pipe 64 has suction holes 64*b* formed on its two adjacent side surfaces, so that the two adjacent side surfaces can be selectively used as suction holding surfaces for the label L. On one of the side surfaces, a plurality of suction holes 64*b* are formed at a central portion in the width direction of the side surface; and on the other side surface, suction holes 64*b* are formed at an end in the width direction of the side surface.

The smaller-diameter portion 62 of the base pipe 61 has a slit 62*a* formed by cutting off a part of the circumferential portion of the smaller-diameter portion 62 in the longitudinal direction thereof, so that only the suction holes 64*b* formed on either one of the side surfaces of the outer pipe 64 can be communicated with the suction passage 61*a*.

As shown in FIG. 14, in each of the outer pipes 64 of the first suction rod 60A and the fourth suction rod 60D, the suction holes 64*b* are formed at the right end in the width direction of the side surface adjacent to the left of the side surface, at the central portion in the width direction of which the suction holes 64*b* are formed. In each of the outer pipes 64 of the second suction rod 60B and the third suction rod 60C, the suction holes 64*b* are formed at the left end in the width direction of the side surface adjacent to the right of the side surface, at the central portion in the width direction of which the suction holes 64*b* are formed.

Figure 15:
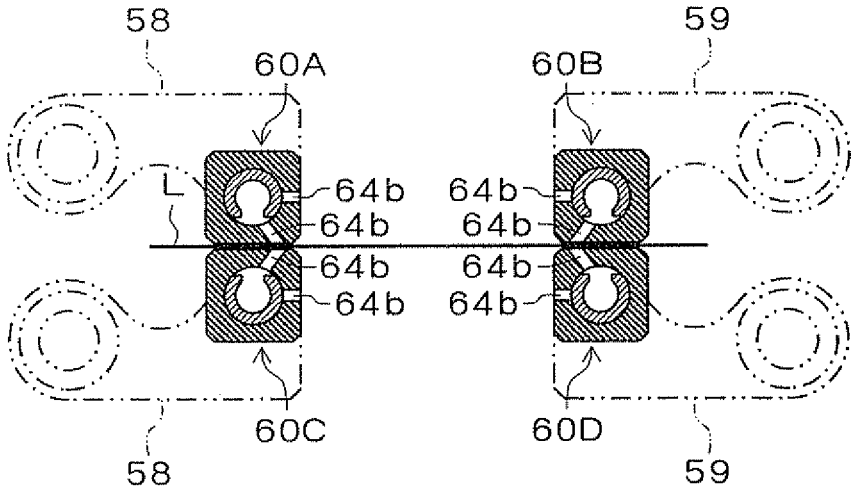
FIG. 15 (*a*) is a plan view of the state where the label opener grips the sheet-like folded label on different suction holding surfaces of the label opener.
Figure 15:
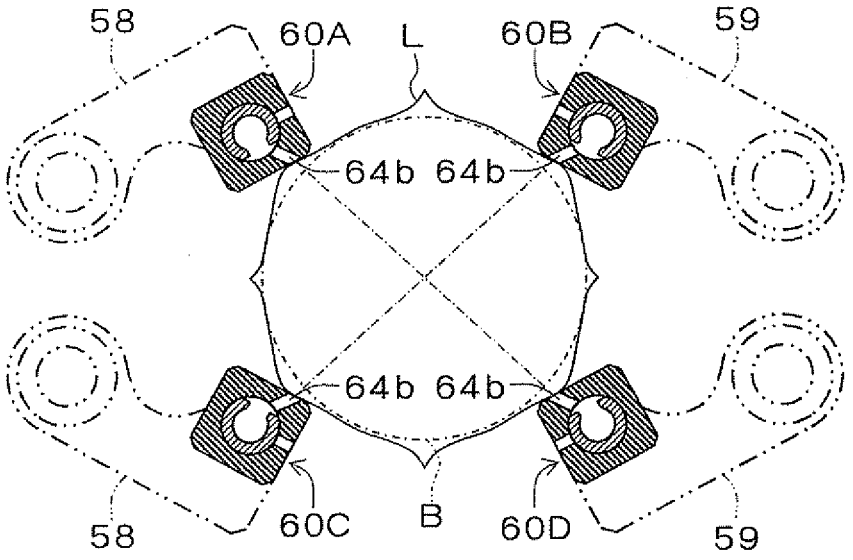

Therefore, if a comparison is made between: the case where, as shown in FIG. 14 (*a*) and (*b*), the side surface, at the central portion in the width direction of which the suction holes 64*b* are formed, is used as a suction holding surface for the label L; and the case where, as shown in FIG. 15 (*a*) and (*b*), the side surface, at an end in the width direction of which the suction holes 64*b* are formed, is used as a suction holding surface for the label L, the distance between the suction holes 64*b* of the first suction rod 60A and the suction holes 64*b* of the second suction rod 60B, and the distance between the suction holes 64*b* of the third suction rod 60C and the suction holes 64*b* of the fourth suction rod 60D change. This makes it possible, as shown in FIG. 14 (*a*) and (*b*) and FIG. 15 (*a*) and (*b*), to handle various types of labels L different in folded width.

Further, at the upper end of the smaller-diameter portion 62 of the base pipe 61, a convex section 62*b* is formed at the position corresponding to the slit 62*a* so as to protrude outwardly in the radial direction of the base pipe 61. The engagement of the convex section 62*b* with a concave section 64*c* formed at the upper end of each side surface of the outer pipe 64 positions the outer pipe 64 in the circumferential direction of the base pipe 61.

Therefore, to switch suction holding surfaces for the label L, the outer pipe 64 may be pushed down relative to the base pipe 61 against the bias force of the coil spring 66, whereby the engagement is released between the convex section 62*b* of the base pipe 61 and the concave section 64*c* of the outer pipe 64. Subsequently, the outer pipe 64 may be rotated 90 degrees, and the convex section 62*b* of the base pipe 61 may be engaged with the concave section 64*c* formed on another suction holding surface of the outer pipe 64.

Figure 8:
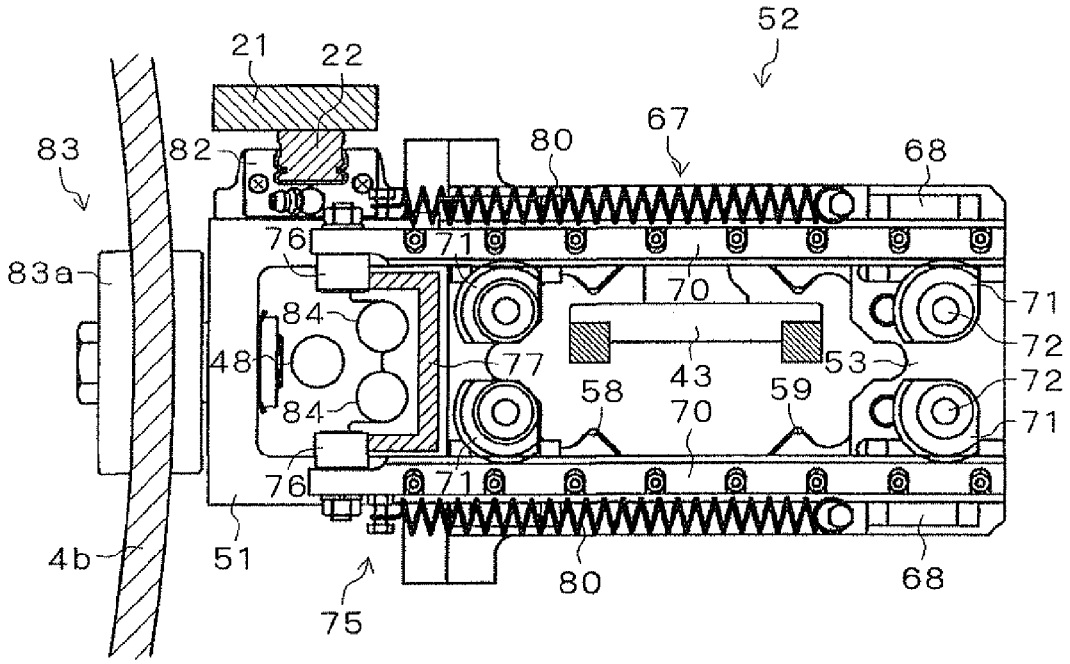
FIG. 8 is a cross-sectional view along line X-X in FIG. 6.
Figure 9:
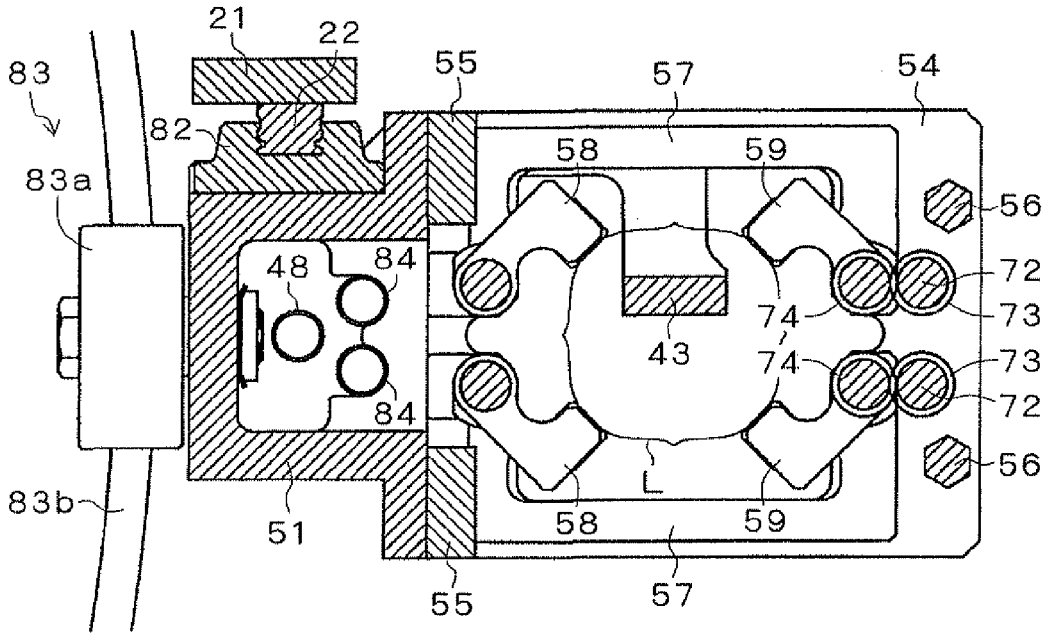
FIG. 9 is a cross-sectional view along line Y-Y in FIG. 6.
Figure 11:
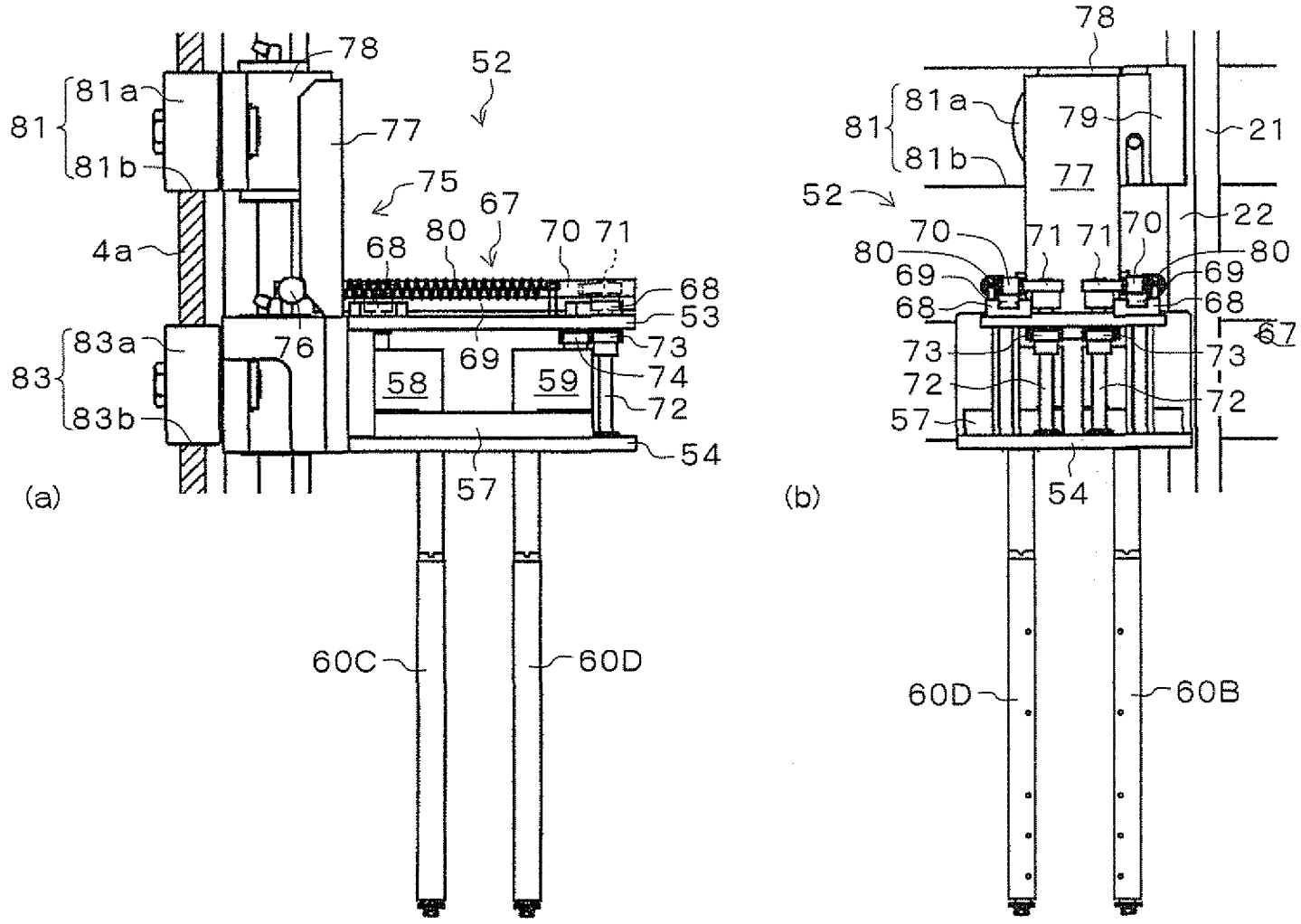
FIG. 11 (*a*) is a front view of a label opener mounted to the label placement head.

As shown in FIGS. 8, 9, and 11, the opening and closing mechanism 67 includes: two pairs, left slide guides 68, 68 and right slide guides 68, 68, attached to the upper surface of the upper base 53; slide rails 69, 69 that advance and retreat in engagement with the respective pairs, left slide guides 68, 68 and right slide guides 68, 68; racks 70, 70 attached to the slide rails 69, 69, respectively; sector gears 71, 71 attached to rotating shafts of one of the pairs, namely the opening and closing arms 58, 58, and sector gears 71, 71 attached to rotating shafts 72, 72 supported so as to be rotatable by the upper base 53 and the lower base 54 on the other pair side, namely the opening and closing arms 59, 59 side, all the sector gears 71, 71 meshed with the corresponding racks 70, 70; spur gears 73, 73 attached to the rotating shafts 72, 72, respectively, below the upper base 53; spur gears 74, 74 attached to the rotating shafts of the other pairs, namely the opening and closing arms 59, 59, meshed with the spur gears 73, 73, respectively; and an advancement-and-retreat driving mechanism 75 that causes the racks 70, 70 to advance and retreat. When the racks 70, 70 advance and retreat, as shown in FIG. 14 (*a*) and (*b*) and FIG. 15 (*a*) and (*b*), the rotating shafts of the opening and closing arms 58, 58 rotate in the directions opposite to each other, and the rotating shafts of the opening and closing arms 59, 59 rotate in the directions opposite to each other, so that the opening and closing arms 58, 58 opposing each other, and the opening and closing arms 59, 59 opposing each other, open and close in a similar manner.

Further, in the state where the opening and closing arms 58, 58 and the opening and closing arms 59, 59 are open, as shown in FIG. 14 (*b*) and FIG. 15 (*b*), the suction holes 64*b* of the first suction rod 60A and the suction holes 64*b* of the fourth suction rod 60D oppose each other, and the suction holes 64*b* of the second suction rod 60B and the suction holes 64*b* of the third suction rod 60C oppose each other. This makes it possible to cleanly open the label L so as to form a shape approximating the shape of the body of the cylindrical bottle B.

The advancement-and-retreat driving mechanism 75 includes: cam followers 76, 76 each attached to one end of the corresponding one of the racks 70, 70; a cam member 77 having cam surfaces abutting the cam followers 76, 76 from the directions of the other ends of the racks 70, respectively; a slide guide 79 to which the cam member 77 is attached via a base member 78 and which rises and falls along the slide rail 22 fixed to the support frame 21; coil springs 80, 80, one end of each of which is coupled to one end of the corresponding one of the racks 70, 70, and the other ends of which are coupled to the upper base 53, and which bias the respective racks 70, 70 to the other end side; and a cam mechanism 81 that causes the cam member 77 attached to the slide guide 79 via the base member 78 to rise and fall. The cam mechanism 81 includes: a cam follower 81*a* attached to the base member 78; and a cam groove 81*b* formed on the cylindrical body 4*b* provided inside the label placement head 20 in a fixed manner, the cam follower 81*a* fitting the cam groove 81*b*.

Therefore, the rise and fall of the cam follower 81*a* along the cam groove 81*b* cause the slide guide 79 attached to the base member 78 to rise and fall along the slide rail 22. Accordingly, the cam member 77 attached to the base member 78 rises and falls. Consequently, the rise and fall motion of the cam member 77 and the bias forces of the coil springs 80, 80 cause the racks 70, 70 to advance and retreat at predetermined timing.

As shown in FIG. 9, the cam mechanism 83 that causes the main unit 52 to rise and fall includes: a cam follower 83*a* attached to the base member 51; and a cam groove 83*b* formed on the cylindrical body 4*b* provided inside the label placement head 20 in a fixed manner, the cam follower 83*a* fitting the cam groove 83*b*. The rise and fall of the cam follower 83*a* along the cam groove 83*b* cause the slide guide 82 attached to the base member 51 to rise and fall along the slide rail 22. Accordingly, the main unit 52 attached to the base member 51 rises and falls.

Figure 16:
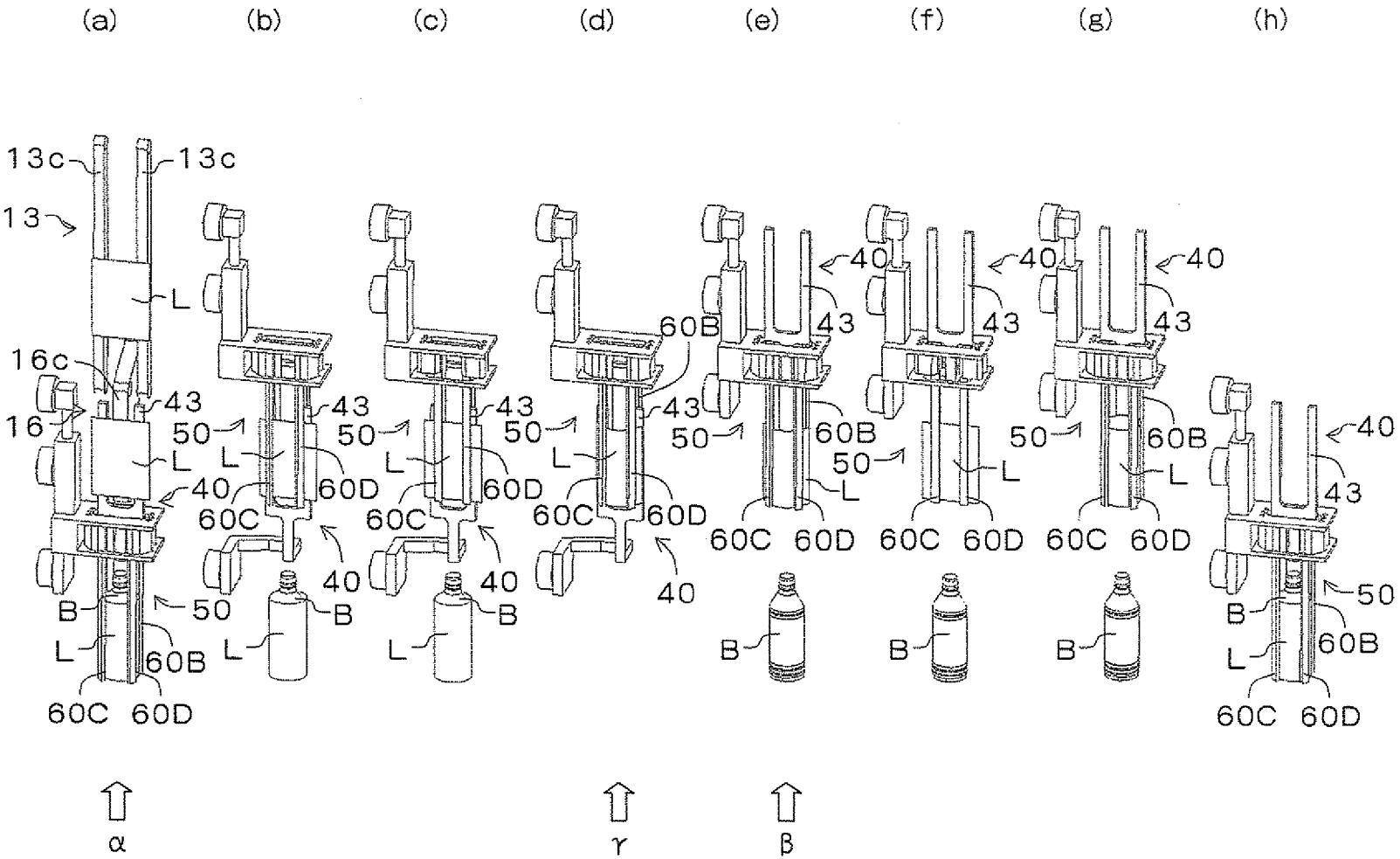
FIG. 16 (*a*) through (*h*) is a perspective view of a label placement operation of the label placement head.

With reference to FIGS. 16 through 20, a description is given of the operation of the label placement head 20 of the label placement apparatus 4, from the reception of the label L to the placement of the label L around the bottle B. As shown in FIG. 16 (*a*) and FIG. 17 (*a*) and (*b*), the take-up member 43 of the label delivery unit 40, when passing through the label supply position α, receives the label L so as to hook it, the label L delivered by the upstream belt conveying unit 13 of the label supplying apparatus 3 and supplied to the label supply position α so as to be held by suction by the feed belt 16*c* of the downstream belt conveying unit 16. Then, the take-up member 43 holds the label L by suction on the label holding surfaces. At this time, a bottle B around which another label L is placed is mounted on the bottle mounting stand 31 of the bottle holding unit 30, and the first through fourth suction rods 60A, 60B, 60C, and 60D of the label opener 50 that had lowered have released the suctioning of said another label L and separated from said another label L.

Figure 17:
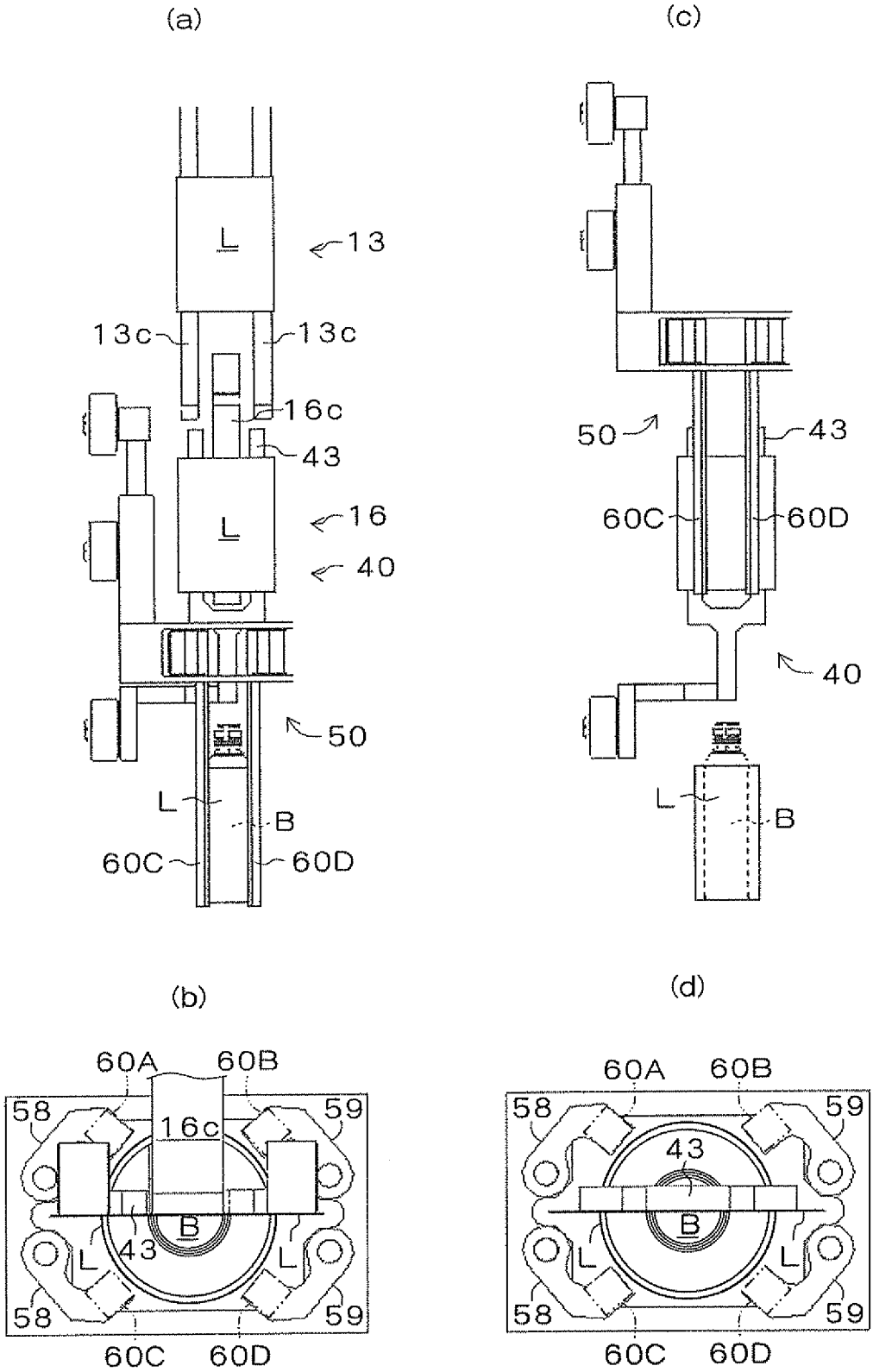
FIG. 17 (*a*) and (*c*) is a front view of the label placement operation of the label placement head.

Next, as shown in FIG. 16 (*b*) and FIG. 17 (*c*) and (*d*), the first through fourth suction rods 60A, 60B, 60C, and 60D of the label opener 50 rise to the height position of the label L held by suction by the take-up member 43. Subsequently, as shown in FIG. 16 (*c*) and FIG. 18 (*a*) and (*b*), only the opening and closing arms 58 and 59 on the opposite side of the take-up member 43 across the label L close, and the third suction rod 60C and the fourth suction rod 60D hold the label L by suction by sandwiching the label L between these rods and the take-up member 43. Subsequently, the holding of the label L by suction by the take-up member 43 is released, whereby the label L is delivered from the take-up member 43 to the third suction rod 60C and the fourth suction rod 60D.

Figure 18:
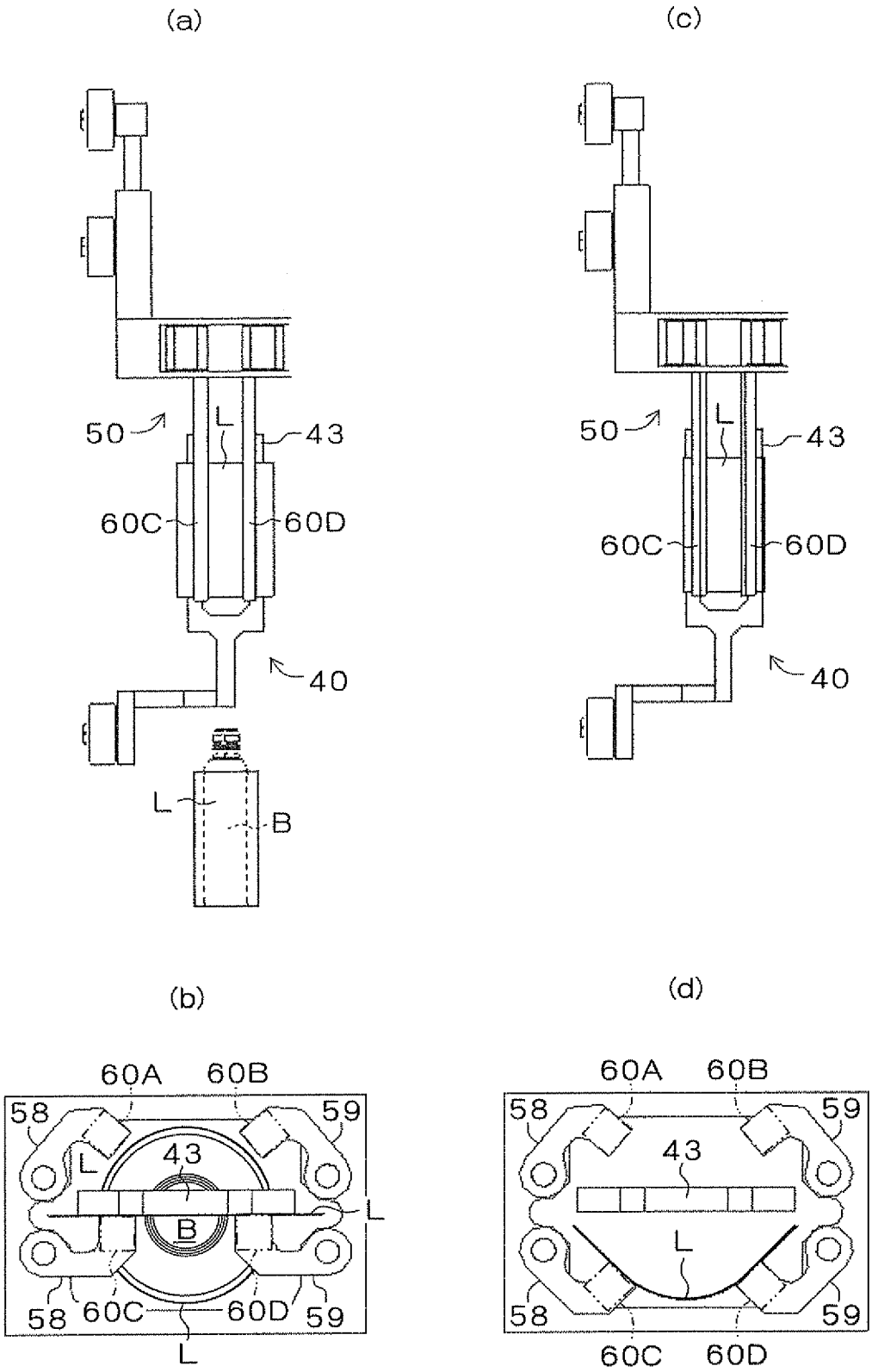
FIG. 18 (*a*) and (*c*) is a front view of the label placement operation of the label placement head.

Subsequently, as shown in FIG. 16 (*d*) and FIG. 18 (*c*) and (*d*), the opening and closing arms 58 and 59 to which the third suction rod 60C and the fourth suction rod 60D holding the label L by suction are attached open. This separates the label L from the take-up member 43. At this time, the label placement head 20 has moved to the bottle sending position γ, and the bottle B around which said another label L is placed and which is mounted on the bottle mounting stand 31 of the bottle holding unit 30, is delivered by the bottle delivery unit 5*a* of the bottle discharge apparatus 5 to the bottle sending unit having the belt conveyor 6.

Figure 19:
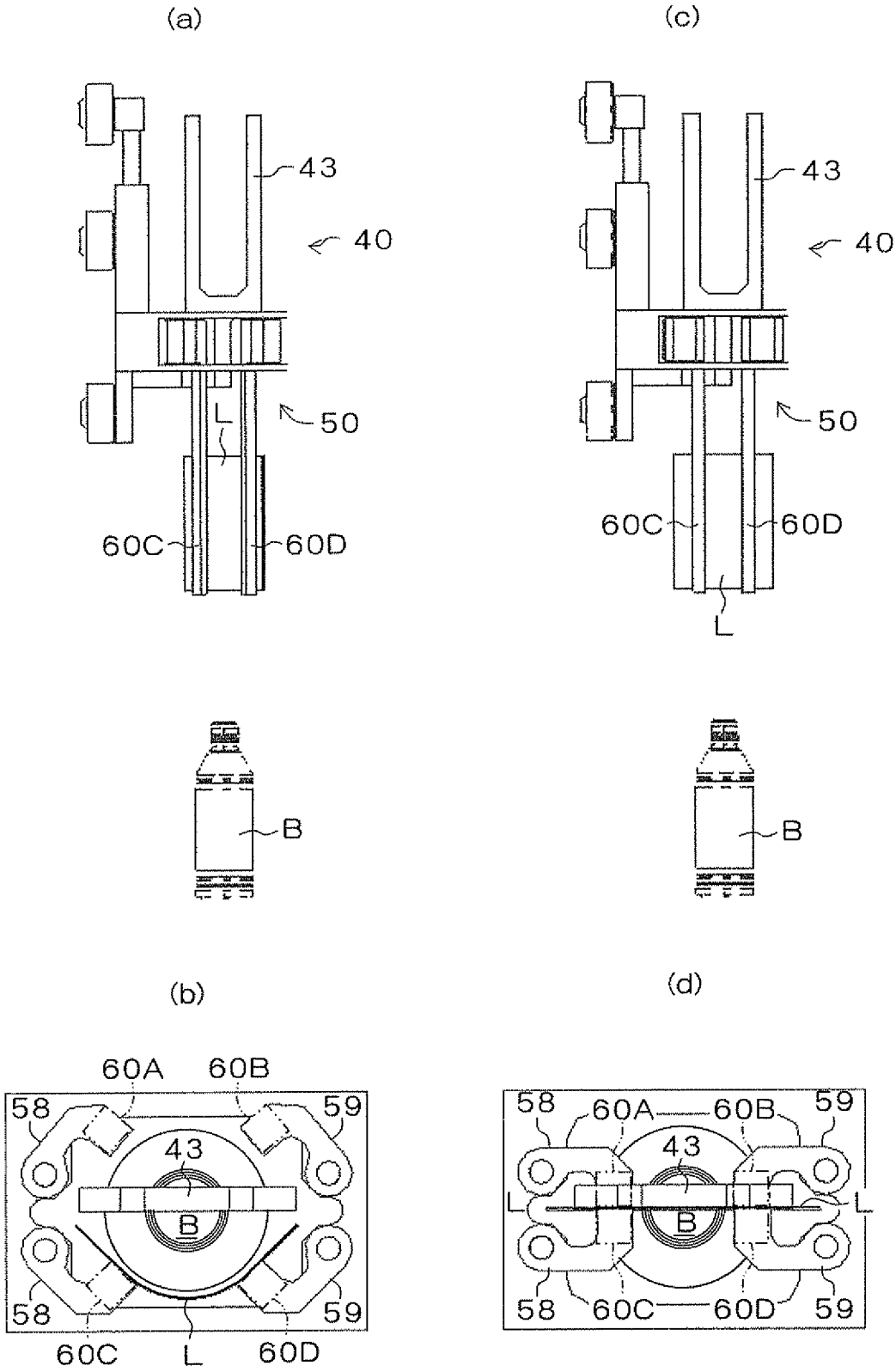
FIG. 19 (*a*) and (*c*) is a front view of the label placement operation of the label placement head.

Next, the label placement head 20 moves to the bottle supply position β, and as shown in FIG. 16 (*e*) and FIG. 19 (*a*) and (*b*), a new bottle B is supplied to the bottle mounting stand 31 of the bottle holding unit 30, and the label delivery unit 40 rises. Consequently, the take-up member 43 withdraws from the position where the third suction rod 60C and the fourth suction rod 60D hold the label L by suction. Subsequently, as shown in FIG. 16 (*f*) and FIG. 19 (*c*) and (*d*), the two pairs, opening and closing arms 58, 58 and opening and closing arms 59, 59, close together, whereby the first and second suction rods 60A and 60B and the third and fourth suction rods 60C and 60D grip the label L by suction.

Figure 20:
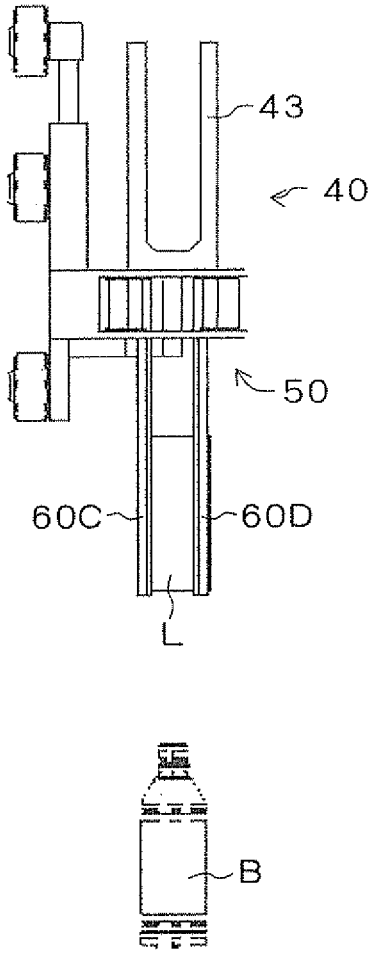
FIG. 20 (*a*) and (*c*) is a front view of the label placement operation of the label placement head.
Figure 20:
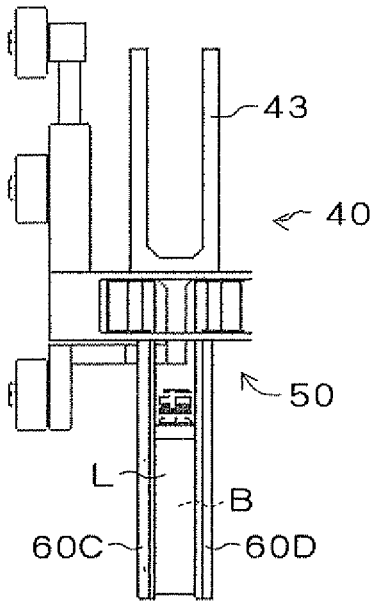
Figure 20:
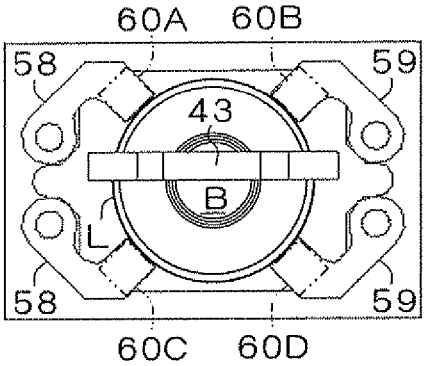
Figure 20:
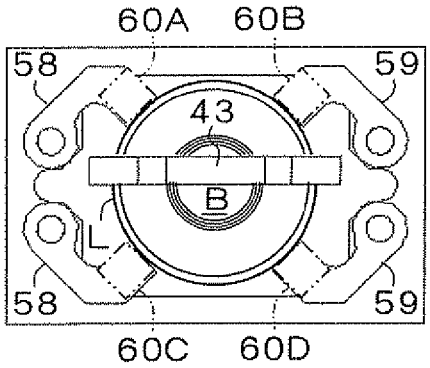
Figure 21:
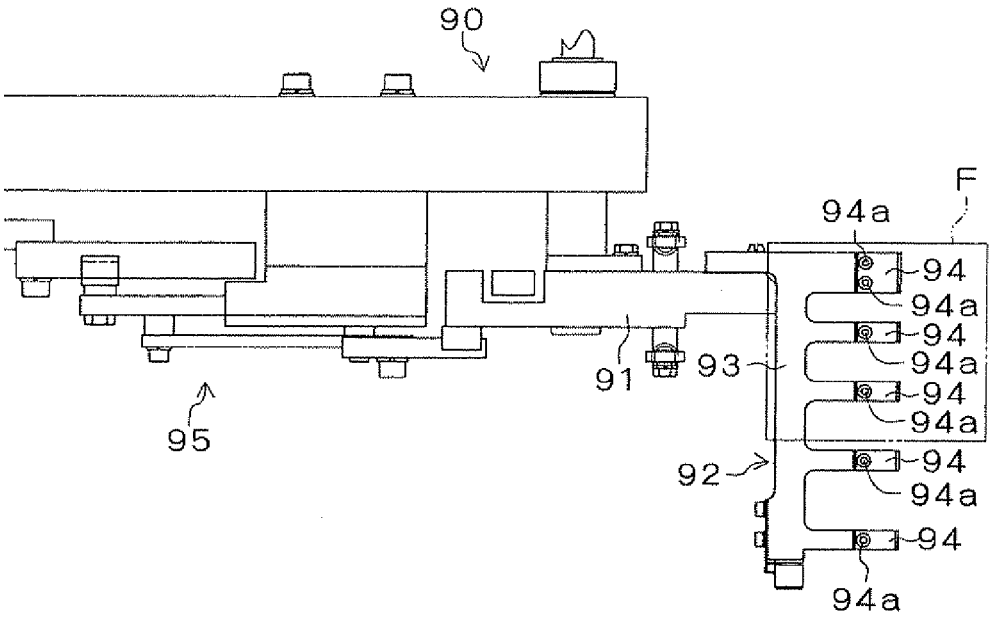
FIG. 21 is a side view of a conventional film opener.
Figure 22:
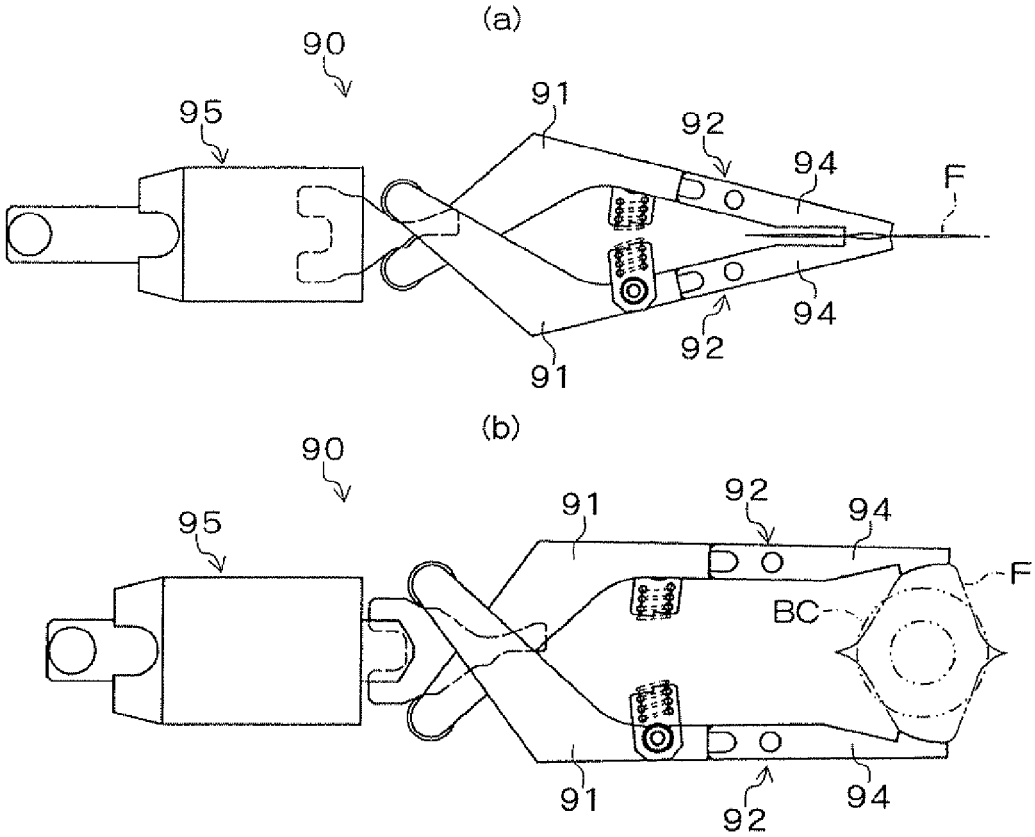
FIG. 22 (*a*) is a plan view of the state where the film opener grips a film.
Figure 23:
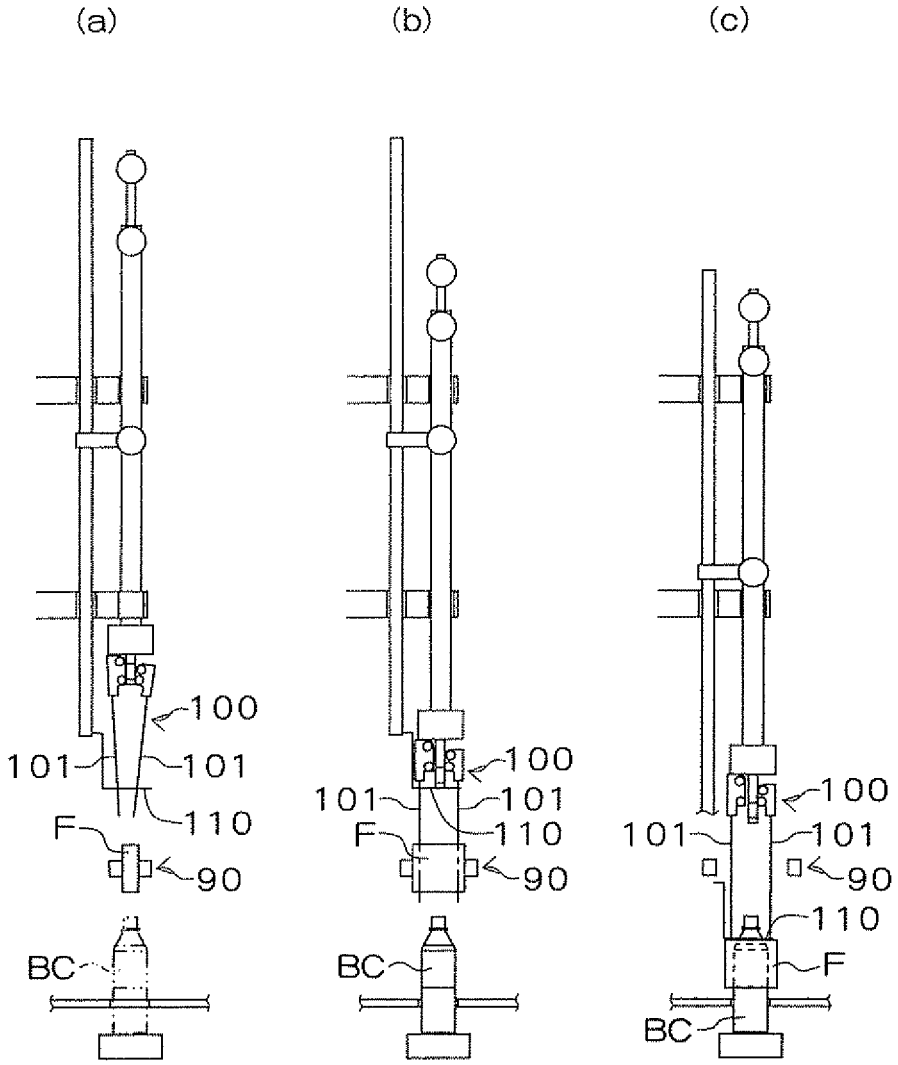
FIG. 23 (*a*) through (*c*) is schematic diagrams showing an indirect method of inserting a bottle container or the like into a film opened by the film opener.

Subsequently, as shown in FIG. 16 (*g*) and FIG. 20 (*a*) and (*b*), the two pairs, opening and closing arms 58, 58 and opening and closing arms 59, 59, open together, whereby the first and second suction rods 60A and 60B and the third and fourth suction rods 60C and 60D open the label L. Subsequently, as shown in FIG. 16 (*h*) and FIG. 20 (*c*) and (*d*), the label delivery unit 40 and the label opener 50 lower, whereby the label L opened by the first and second suction rods 60A and 60B and the third and fourth suction rods 60C and 60D is placed around the body of the bottle B held by suction on the bottle mounting stand 31.

After the label L has thus been placed around the bottle B, the process described above that is shown in FIG. 16 (*a*) through (*d*) is performed, whereby the bottle B around which the label L is placed is delivered to the bottle discharge apparatus 5.

As described above, in the label opener 50 mounted to the label placement head 20 of the label placement system 1, in the state where the first and second suction rods 60A and 60B and the third and fourth suction rods 60C and 60D have opened the label L as a result of the two pairs, opening and closing arms 58, 58 and opening and closing arms 59, 59, opening together, as shown in FIG. 14 (*b*), the suction holes 64*b* of the first suction rod 60A and the suction holes 64*b* of the fourth suction rod 60D oppose each other, and the suction holes 64*b* of the second suction rod 60B and the suction holes 64*b* of the third suction rod 60C oppose each other. This makes it possible to cleanly open the label L so as to form a shape approximating the shape of the body of the cylindrical bottle B.

Therefore, when the label L opened by the label opener 50 is placed around the bottle B, the bottle B hardly makes contact with the label L. This makes it possible to smoothly and securely place the label L around the bottle B even if the label L is tight and thin, having a thickness of from 20 μm to 40 μm. The present invention is effective particularly in placing an ultrathin label having a thickness of from 20 μm to 30 μm.

Further, in the label opener 50, the suction holes 64*b* are formed on two adjacent side surfaces of the outer pipe 64 included in each of the first through fourth suction rods 60A, 60B, 60C, and 60D, so that the two side surfaces can be used as suction holding surfaces for the label L. In addition, the suction holes 64*b* are formed on the corresponding side surfaces at positions different in the width directions of the side surfaces, and therefore, only the rotations of the outer pipes 64 of the first through fourth suction rods 60A, 60B, 60C, and 60D make it possible to change the distance between the suction position of the first suction rod 60A and the suction position of the second suction rod 60B, and the distance between the suction position of the third suction rod 60C and the suction position of the fourth suction rod 60D. Thus, even when the width of the label L has been changed within a certain range, it is not necessary to replace the label opener 50 per se. This facilitates switching the models of the film opener 50.

Further, in the label placement system 1, the label delivery unit 40 is mounted to the label placement head 2Q. This makes it possible to deliver the label L from the label delivery unit 40 to the label opener 50 in a stable state, and has the effect that a shift is unlikely to occur in the position of the label L when the label L is delivered from the label delivery unit 40 to the label opener 50.

It should be noted that in the embodiment described above, the suction holes 64*b* are formed on two adjacent side surfaces of the outer pipe 64 included in each of the suction rods 60A, 60B, 60C, and 60D. The present invention, however, is not limited to this. Alternatively, it is possible to form suction holes on three or all side surfaces. This has the effect that the range of application of the width of the label is extended.

Further, in the embodiment described above, the suction holes 64*b* are formed on a plurality of side surfaces of the outer pipe 64. The present invention, however, is not limited to this. Alternatively, a wide suction holding surface may be formed on a suction rod, and a plurality of sets of suction holes may be formed on the wide suction holding surface at positions different in the width direction of the surface. Then, appropriate suction passage switching means may be provided, whereby a suction passage is communicated only with any one of the sets of suction holes.

Further, in the embodiment described above, the description is given of the label placement system 1 for placing the tubular label L around the body of the bottle B. The present invention, however, is not limited to this, and, needless to say, can be applied to the case where a tubular film is placed around various placement targets.

INDUSTRIAL APPLICABILITY

It is possible to cleanly open a tubular film so as to form a round shape or a generally rectangular shape. Accordingly, when the opened film is placed around the body of, for example, a round bottle or a rectangular bottle, the lower end of the film is unlikely to make contact with the shoulder of the round bottle or the rectangular bottle. Thus, the present invention can be applied to the case where an insufficiently stiff thin film is placed around a bottle container or the like.

The invention claimed is:

1. A film placement system comprising:

a placement target supplying apparatus for supplying a placement target to a placement target supply position;

a film supplying apparatus for supplying a sheet-like folded tubular film to a film supply position;

a rotary film placement apparatus for receiving the placement target supplied by the placement target supplying apparatus at the placement target supply position and conveying the placement target to a placement target sending position, and also for receiving the film supplied by the film supplying apparatus at the film supply position and placing the film around the placement target while conveying the placement target from the placement target supply position to the placement target sending position; and a placement target discharge apparatus for discharging the placement target around which the film has been placed by the film placement apparatus, wherein the film placement apparatus includes numerous film placement heads attached at regular intervals in a concentric circle around a rotating shaft, and a film opener is mounted to each of the film placement heads for opening a tubular film supplied so as to be sheet-like folded and placing the tubular film around a placement target, the film opener comprising:

a first suction rod and a second suction rod that suction one side of the sheet-like folded film at a predetermined distance therebetween in a width direction of the film, the first suction rod and the second suction rod each extending in a longitudinal direction of the film; and a third suction rod and a fourth suction rod that suction the other side of the film at positions corresponding to the first suction rod and the second suction rod, the third suction rod and the fourth suction rod each extending in the longitudinal direction of the film, wherein the first suction rod and the second suction rod that suction the one side of the film, and the third suction rod and the fourth suction rod that suction the other side of the film, separate from each other, and thereby the sheet-like folded film is opened, in a state where the film is open, suction holes of the first suction rod and suction holes of the fourth suction rod oppose each other, and suction holes of the second suction rod and suction holes of the third suction rod oppose each other.

2. The film placement system according to claim 1, wherein the film opener places the film around the placement target by lowering while opening the film.

3. A film placement system according to claim 1, wherein a distance between a suction position of the first suction rod and a suction position of the second suction rod and a distance between a suction position of the third suction rod and a suction position of the fourth suction rod are changeable.

4. The film placement system according to claim 3, wherein a film delivery unit is mounted to each of the film placement heads, the film delivery unit receiving the film supplied by the film supplying apparatus at the film supply position and delivering the film to the film opener.

5. The film placement system according to claim 4, wherein the film delivery unit includes a take-up member that holds one side of the film, supplied to the film supply position, by suction.

6. The film placement system according to claim 5, wherein the film delivery unit and the film opener rise and fall independently of each other.

7. The film placement system according to claim 5, wherein the take-up member enters between: the first suction rod and the second suction rod; and the third suction rod and the fourth suction rod, in a state where the first suction rod and the second suction rod are separate from the third suction rod and the fourth suction rod.

8. The film placement system according to claim 1, wherein a film delivery unit is mounted to each of the film placement heads, the film delivery unit receiving the film supplied by the film supplying apparatus at the film supply position and delivering the film to the film opener.

9. The film placement system according to claim 8, wherein the film delivery unit includes a take-up member that holds one side of the film, supplied to the film supply position, by suction.

10. The film placement system according to claim 9, wherein the film opener receives the film from the take-up member as a result of: the first suction rod and the second suction rod, or the third suction rod and the fourth suction rod, holding the film by suction by sandwiching the film between the corresponding suction rods and the take-up member; and the take-up member releasing the suctioning of the film.

11. The film placement system according to claim 9, wherein the take-up member enters between: the first suction rod and the second suction rod; and the third suction rod and the fourth suction rod, in a state where the first suction rod and the second suction rod are separate from the third suction rod and the fourth suction rod.

* * * * *